US007585018B2

(12) United States Patent
LaPointe et al.

(10) Patent No.: US 7,585,018 B2
(45) Date of Patent: Sep. 8, 2009

(54) WALL PROXIMITY RECLINING CHAIR WITH IN-LINE LINKAGE MECHANISM

(75) Inventors: Larry P. LaPointe, Temperance, MI (US); Richard E. Marshall, Monroe, MI (US); Brian C. Fredricks, Monroe, MI (US); David Collins, Ida, MI (US); Richard D. Hartford, Maybee, MI (US); Gerald G. Stotz, Ida, MI (US); Michael Gaines, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 359 days.

(21) Appl. No.: 11/328,772

(22) Filed: Jan. 10, 2006

(65) Prior Publication Data

US 2007/0158980 A1 Jul. 12, 2007

(51) Int. Cl.
*A47C 1/02* (2006.01)

(52) U.S. Cl. ..... 297/85

(58) Field of Classification Search ..... 297/85, 297/84, 83, 68

See application file for complete search history.

(56) References Cited

U.S. PATENT DOCUMENTS 3,325,210 A 6/1967 Knabusch et al.
4,307,912 A 12/1981 Watt et al.
4,367,895 A 1/1983 Pacitti et al.
5,427,431 A 6/1995 Saul et al.
5,480,209 A 1/1996 May
5,570,927 A * 11/1996 LaPointe et al. ..... 297/85
6,145,924 A 11/2000 Mero, Jr. et al.
6,231,120 B1 5/2001 Wiecek
6,557,934 B2 5/2003 Wiecek
6,655,732 B1 12/2003 LaPointe
6,945,599 B2 9/2005 May
2005/0017561 A1 1/2005 Burmeister, III et al.

OTHER PUBLICATIONS

International Search Report for International Application No. PCT/US2007/000577 Dated Nov. 25, 2008 (9 pages).

* cited by examiner

*Primary Examiner*—Milton Nelson, Jr.

(57) ABSTRACT

A furniture member actuation mechanism includes first and second side plates with polymeric inserts each having an elongated slot each receiving a first or second pin. First and second seat back support elements are provided, the first element rotatably coupled to the first side plate and rotatably linked to the first pin and the second element rotatably coupled to the second side plate and rotatably linked to the second pin. First and second leg rest support arms are each connected by a pantograph linkage set to a drive rod disposed through the side plates. A rearward force applied by an occupant to the support elements rotates them rearward with the first and second pins sliding within the elongated slots. An occupant's weight when the rearward force is removed returns the support elements to a pre-rotation position. A cam adjusts a weight a leg rest can hold.

56 Claims, 16 Drawing Sheets

FIG 9
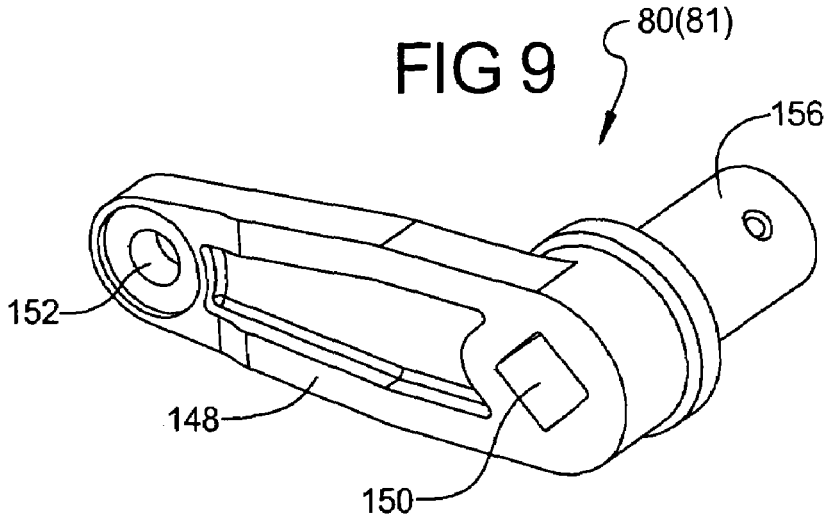
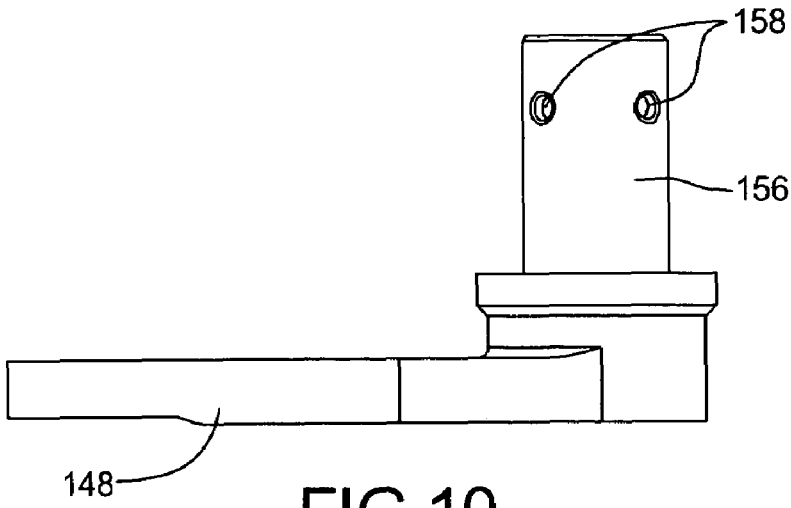
FIG 10
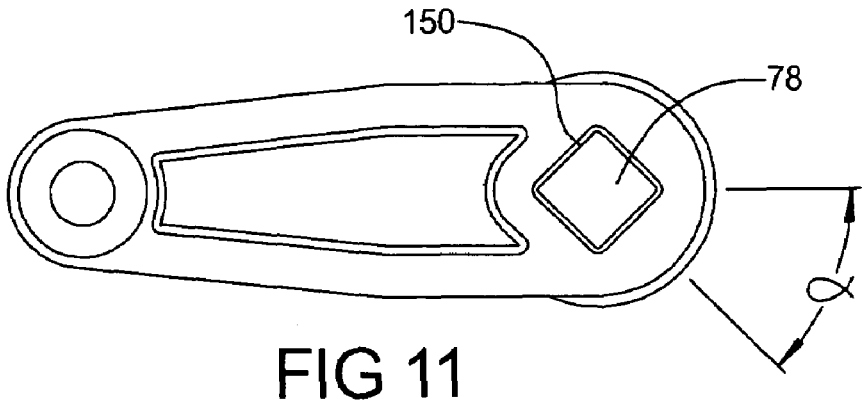
FIG 11

FIG 12
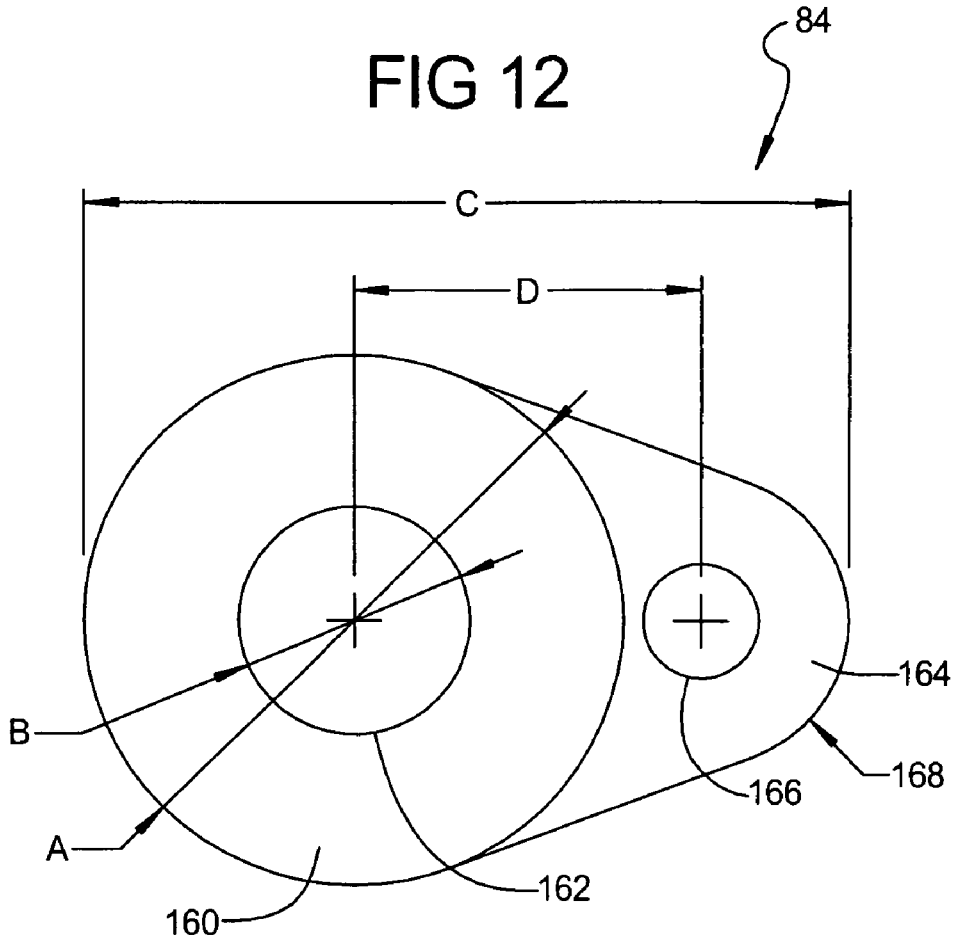
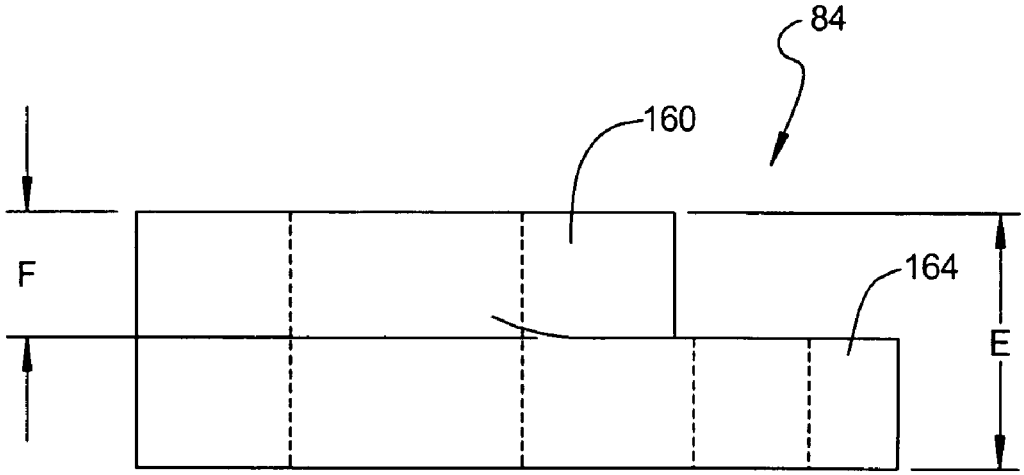
FIG 13

FIG 14
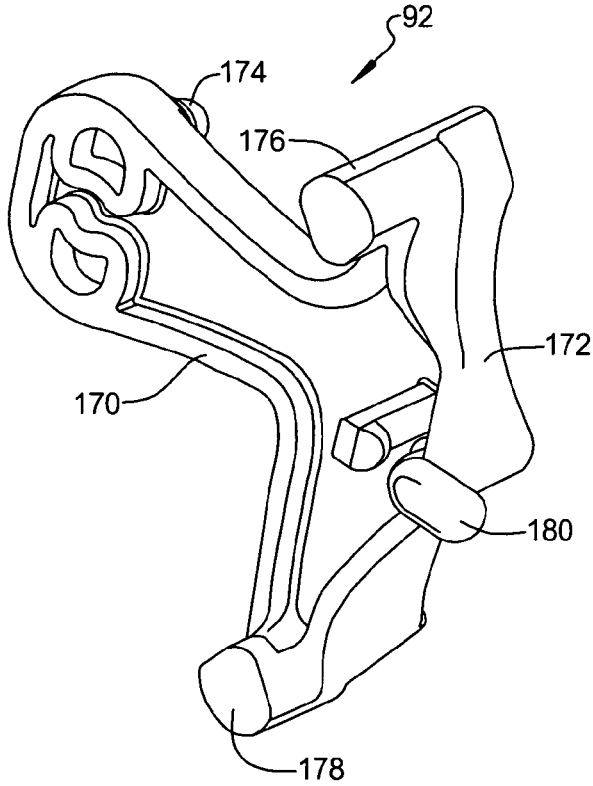
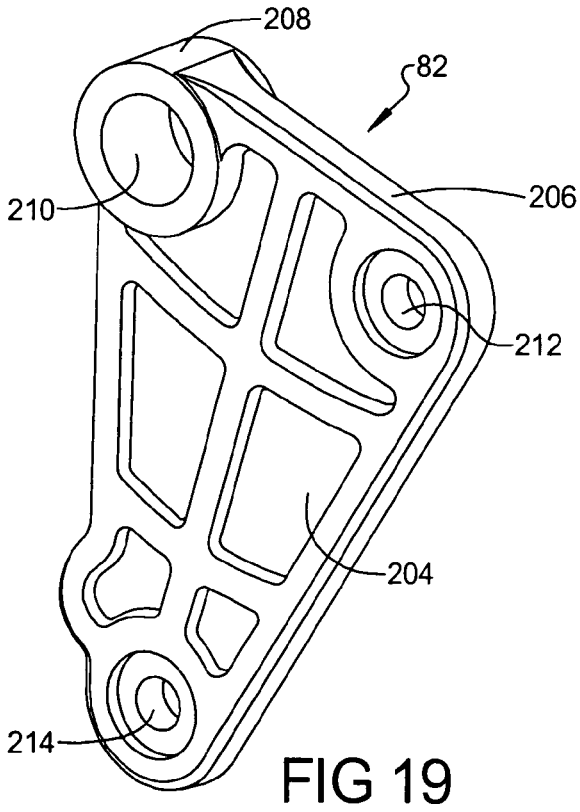
FIG 19

FIG 28
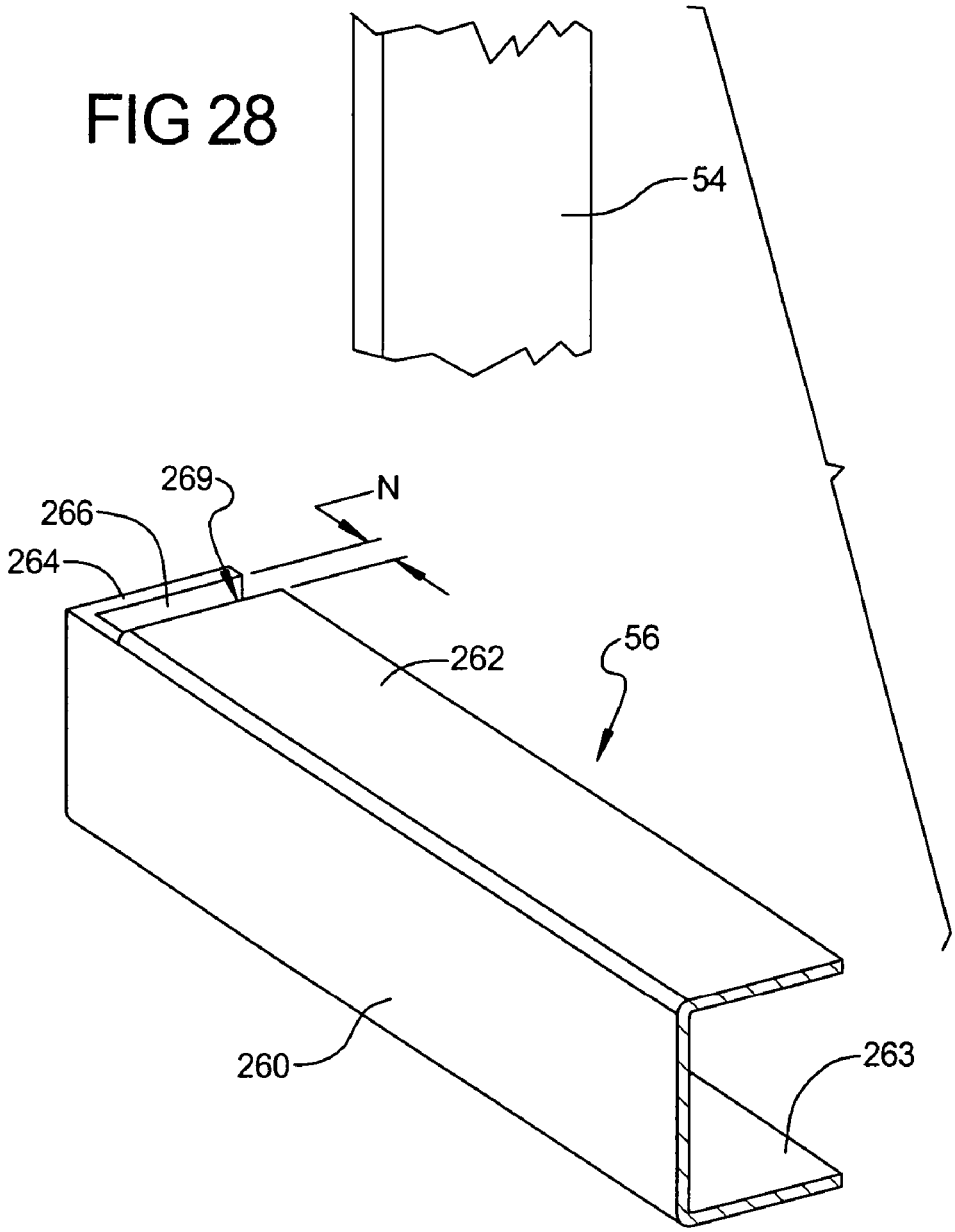
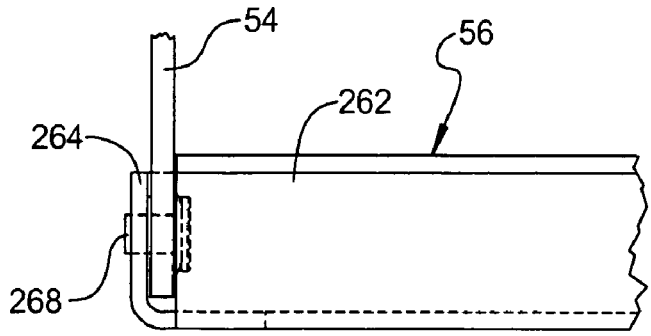
FIG 29

WALL PROXIMITY RECLINING CHAIR WITH IN-LINE LINKAGE MECHANISM

FIELD

The present disclosure relates to furniture member operating mechanisms and to a device and method for operating a reclining furniture member assembly.

BACKGROUND

The statements in this section merely provide background information related to the present disclosure and may not constitute prior art.

Conventionally, reclining articles of furniture (i.e., chairs, sofas, loveseats, and the like) require a mechanism to bias a leg rest assembly in the extended and stowed positions. Known mechanisms commonly include a large number of moving parts that tends to increase the manufacturing time and costs associated with the furniture.

Most reclining rocking chairs include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly. Disadvantages of known mechanisms for providing these functions include a large quantity of parts and their requirement of one or several spring biasing elements to permit retraction of the various chair components from their extended positions.

As an additional comfort feature, a latching mechanism may also be provided for releasably retaining the chair frame in one or more rearwardly rocked or "tilted" positions on the base assembly following extension of the leg rest assembly towards its extended position. In this manner, normal "rocking" action of the rocking chair is inhibited until the leg rest assembly is returned to its normally "stowed" position. Known leg rest mechanisms also provide multiple functional positions, which can be reached using a detente mechanism, which temporarily holds the leg rest at each successive position. A disadvantage of this mechanism design results as the furniture member rocks backward when the leg rest is moved between the successive positions. An improved mechanism is therefore desirable to eliminate the above disadvantages.

SUMMARY

According to several embodiments of the present disclosure, a furniture member actuation mechanism includes opposed first and second side plates, having first and second polymeric motion inserts, the first motion insert connected to the first side plate and the second motion insert connected to the second side plate. Each motion insert has an elongated slot. A first pin is inserted through the elongated slot of the first motion insert. A second pin is inserted through the elongated slot of the second motion insert. First and second seat back support elements are included, the first element rotatably coupled to the first side plate and rotatably linked to the first pin and the second element rotatably coupled to the second side plate and rotatably linked to the second pin. A rearward force applied by an occupant to both the first and second seat back support elements is operable to create a rearward rotation of the seat back support elements with the first and second pins slidable within the elongated slots, and a weight of the occupant when the rearward force is removed is operable to return the seat back support elements to a pre-rotation position.

According to other embodiments, a drive rod is rotatably disposed through both the first and second side plates. The first and second leg rest support arms are each connected by a pantograph linkage set to the drive rod. A cam is connected to the second side plate. Rotation of the drive rod is operable to rotate the first and second leg rest support arms between a stowed and an extended position. The cam is rotatable to adjust an occupant load applied to the leg rest support arms to return the leg rest support arms from the extended position to the stowed position.

According to still further embodiments, a substantially rectangular shaped frame includes first and second lateral members and first and second transverse members coupled to the first and second lateral members. A first forward oriented link member and a first rearward oriented link member both connect the first side plate to the first lateral element. Second forward and rearward oriented link members both connect the second side plate to the second lateral element. A first cross brace connects the first and second forward oriented link members. A second cross brace connects the first and second rearward oriented link members.

According to yet still further embodiments, a furniture member actuation mechanism includes a plate connected by first and second links to a frame. First and second polymeric motion inserts are connected to the plate, each of the motion inserts having an elongated slot. A seat back support element is rotatably connected to the plate. A first pin is slidably received in the elongated slot of the first motion insert and rotatably linked to both the seat back support element and the first link. A leg rest support arm is connected by a pantograph linkage set to the plate. A second pin is connected by a cross link to the first pin and rotatably coupled to the second link, the second pin being slidable within the elongated slot of the second motion insert when the pantograph linkage set operates between each of a retracted and an extended position.

According to still further embodiments, a drive rod is rotatably connected between the first and second side plates. A lock link is coupled to the drive rod proximate the first side plate. An over-center toggle is rotatably connected to the lock link. A plurality of pantograph linkage sets are connected between each of the first and second side plates and the leg rest. The drive rod is induced to rotate by release of the over-center toggle and rotation of the lock link separately controls a leg rest position.

According to yet still further embodiments, a stop drive link controls the leverage of the linkage mechanism and provides adjustment for the support of an extended footrest. Adjustment is controlled by varying the stop position of the linkage mechanism. The stop drive link also provides a mechanism that transfers an occupant's weight into rotational torque of the drive rod by force transmittal from the furniture member base to the drive rod and a close-to-center three pivot configuration of the mechanism.

Further areas of applicability of the present disclosure will become apparent from the detailed description provided hereinafter. It should be understood that the detailed description and specific examples, while indicating several embodiments of the present disclosure, are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIG. 9 is a perspective view of a leg rest lock link of the present disclosure;

FIG. 10 is a top plan view of the lock link of FIG. 9;

FIG. 11 is a front elevational view of the lock link of FIG. 10;

FIG. 12 is a front elevational view of an over-center toggle of the present disclosure;

FIG. 13 is a top plan view of the over-center toggle of FIG. 12;

FIG. 14 is a perspective view of a trip lever of the present disclosure;

FIG. 19 is a perspective view of a stop drive element of the present disclosure;

FIG. 28 is a perspective partial assembly view of a cross brace and support arm of the present disclosure;

FIG. 29 is a top plan view of an assembled cross brace and support arm of FIG. 28;

DETAILED DESCRIPTION

Figure 1:
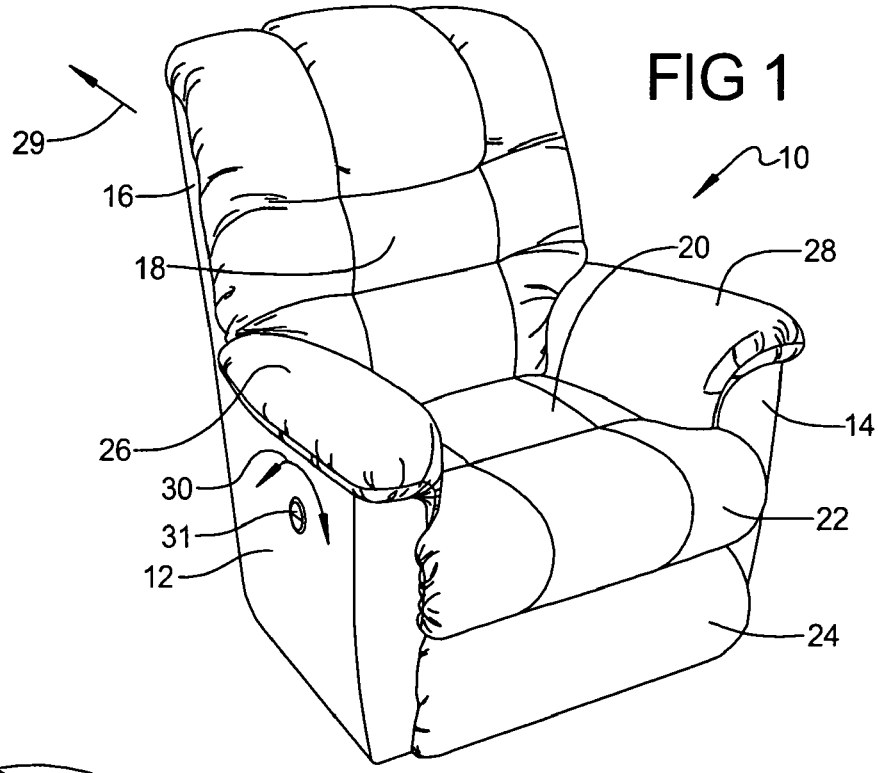
FIG. 1 is a front perspective view of a furniture member having an in-line linkage mechanism of the present disclosure.

The following description is merely exemplary in nature and is not intended to limit the present disclosure, application, or uses. It should be understood that throughout the drawings, corresponding reference numerals indicate like or corresponding parts and features.

With particular reference now to the drawings, in accordance with the present disclosure and referring generally to FIG. 1, a furniture member 10 depicted as a reclining chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest 24 is also provided. First and second arm rest pads 26, 28 can be used to cover the upper surfaces of the first and second sides 12, 14 respectively. An occupant's weight generally centered on support member 20 is normally operable to maintain seat back 16 in an upright position. When leg rest 24 is in the stowed position shown, seat back 16 can "pre-recline" or rotate about a seat back arc of rotation 29 independent of the first and second sides 12, 14, support member 20 or leg rest 24 when the occupant leans backward against seat back 16. Seat back 16 can also be returned to the upright position shown and opposite to seat back arc of rotation 29 by the weight of the occupant when the occupant leans forward. In several embodiments, furniture member 10 can further rotate about a furniture member arc of rotation 30. In the embodiment shown, furniture member 10 is a chair however the present teachings are not limited to chairs. Furniture member 10 can be any of a plurality of furniture members, including, but not limited to single or multiple person furniture members, non-rocking recliners, sofas, sectional members and/or loveseats. In several embodiments, furniture member 10 includes a release latch 31 to manually release the leg rest 24 from the stowed position shown.

Figure 2:
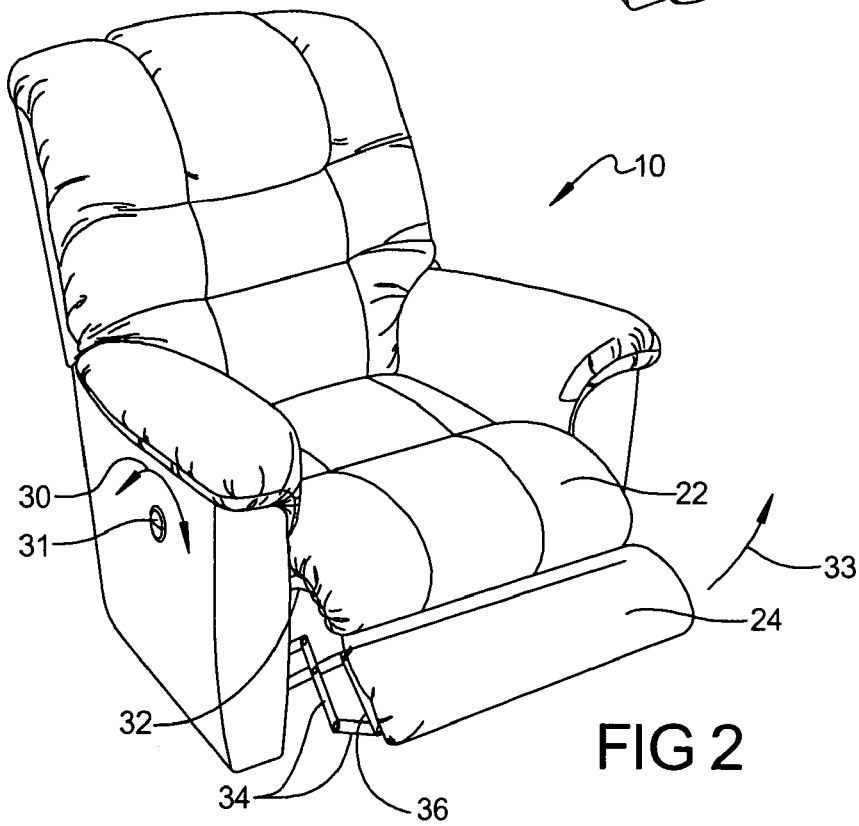
FIG. 2 is a front perspective view of the furniture member of FIG. 1 having a leg rest assembly shown in an extended position.

Referring generally now to FIG. 2, release latch 31 is connected to an actuation mechanism 32 and when release latch 31 is manually actuated, actuation mechanism 32, directs the repositioning of leg rest 24 from the stowed position (shown in FIG. 1) to an extended position by motion of the leg rest 24 about an extension arc 33. It will be apparent that manual rotation of leg rest 24 in an opposite direction from extension arc 33 will return the leg rest 24 to the stowed position. Actuation mechanism 32 supports leg rest 24. More specifically, actuation mechanism 32 includes first and second pantograph linkage sets 34, 35 (second pantograph linkage sets 35 are not visible in this view) which are linked to leg rest 24 using first and second leg rest support arms 36, 37 (only first leg rest support arm 36 is visible in this view).

Figure 3:
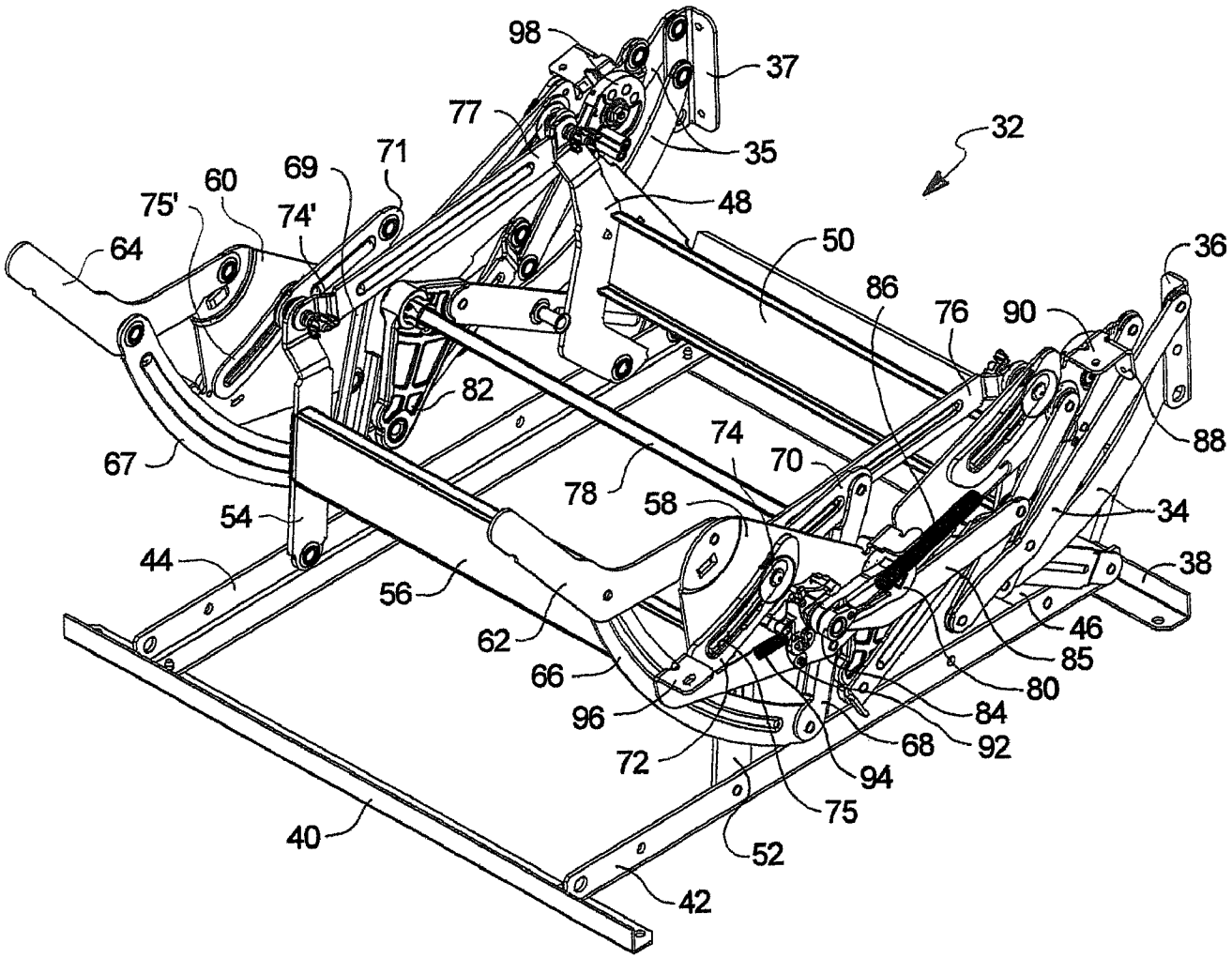
FIG. 3 is a rear perspective view of the actuation mechanism of the present disclosure.

Referring generally now to FIG. 3, the functional and structural aspects of actuation mechanism 32 for use in single or multi-person furniture members 10 is shown. For purposes of clarity, FIG. 3 shows the various pre-assembled frame components with their upholstery, padding, etc. removed to better illustrate the interdependency of the frame components' construction which can be rapidly and rigidly assembled in a relative easy and efficient manner. Therefore, all of the frame components can be individually fabricated or sub-assembled to include the requisite brackets, springs, padding and upholstery on an "off-line" batch-type basis. Thereafter, the various pre-assembled and upholstered furniture components are assembled for totally integrating actuation mechanism 32 therein.

Actuation mechanism 32 provides multiple features which will each be separately described, including: 1) a simplified, rigid frame structure; 2) an occupant induced, gravity or weight return "pre-reclining" function partially described above which does not rely on a spring biasing device, which uses slotted motion inserts and pins that replace common spring/link devices to provide for the "pre-reclining" function; 3) an "over-center" locking link feature which biases the leg rest 24 in the stowed or extended positions without the biasing force of spring elements; 4) a stop drive link which rotates independent of the locking link to provide an additional range of leg rest motion and 5) a cam system that permits manual pre-adjustment of the load that leg rest 24 can support in the extended position.

As generally used herein, the terms front or forward and right hand or left hand refer to the direction an occupant of the furniture member 10 faces when seated or with respect to the occupant's sides when the occupant is seated. The terms rear or rearward refer to a direction opposite to the front or forward direction. The rigid frame structure supporting actuation mechanism 32 includes front and rear cross frame members 38, 40 which in some embodiments can be created from bent or extruded angle elements, of metal such as steel material or composite materials. First and second lateral frame members 42, 44 which in some embodiments are also created from angle elements are connected at opposed ends to each of the front and rear cross frame members 38, 40 by welding or by using connectors such as threaded fasteners or rivets. Occupant loads at the front portion of furniture member 10 are transferred to first and second lateral frame members 42, 44 by first and second front support arms 46, 48 rotatably pinned or riveted to first or second lateral frame members 42, 44. A front cross brace 50 is connected between each of the first and second front support arms 46, 48 by a single fastener at each end of the brace. Similarly, occupant loads at the rear portion of the furniture member 10 are transferred to first and second lateral frame members 42, 44 by first and second rear support arms 52, 54 pinned or riveted to first or second lateral frame members 42, 44. A rear cross brace 56 is connected between each of first and second rear support arms 52, 54 also by a single fastener at each end of the rear cross brace 56. The frame structure can be of made in general of metal such as steel or aluminum, or of one or more polymeric or composite materials. The present disclosure is not limited by the material used for the frame components.

The occupant induced, gravity return "pre-reclining"function is provided by a combination of links and support members and the use of pins slidably retained in motion inserts. The term "motion insert"as used herein refers to a member such as an insert fixedly connected to structure which permits sliding motion of the pin or pins within elongated slots thereof and the further description of "forward or "rear"with respect to these components identifies their installed position with respect to each other and not to a limiting direction of motion permitted. Each of the first and second seat back support elements 62, 64 are rotatably coupled to the first and second side plates 58, 60, respectively, and further rotatably coupled to one end of each of a first or second crescent-shaped actuation link 66, 67. Opposed ends of the first and second actuation links 66, 67 are in turn rotatably coupled to either a first or second flanged link 68, 69, respectively. Opposed ends of the first and second flanged links 68, 69 are rotatably coupled to first and second connecting links 70, 71. Polymeric first and second rear motion inserts 72, 73 are connected to the first and second side plates 58, 60. Opposite ends of the first and second connecting links 70, 71 are pinned using first and second rear motion pins 74, 74' which are further inserted through elongated slots 75, 75' of first and second rear motion inserts 72, 73. First and second rear motion pins 74, 74' are concomitantly inserted through receiving apertures of first and second cross links 76, 77 which connect upper ends of respective pairs of first front support arm 46 and first rear support arm 52, or second front support arm 48 and second rear support arm 54.

Full extension motion of furniture member 10 and leg rest 24 is controlled by a drive rod 78 which is rotatably supported by first and second side plates 58, 60 and connected at opposite ends to leg rest lock links 80, 81 and stop drive elements or links 82 which are themselves located proximate each of the first or second side plates 58, 60. In some embodiments, drive rod 78 is square or rectangular in shape, and is received in a correspondingly shaped aperture of leg rest lock links 80, 81 (lock link 81 is not clearly visible in this view) and opposed stop drive links 82. At an opposite end of leg rest lock link 80 from the connection of drive rod 78, an over-center toggle 84 is rotatably connected. A drive link 85 is also co-rotatably connected with over-center toggle 84 to leg rest lock link 80. An opposite end of drive link 85 is rotatably connected to one of the links of first pantograph linkage set 34. A biasing element 86 which in some embodiments can be a coiled spring is connected between over-center toggle 84 and an aperture and a notch 88 formed in a bracket 90 integrally joined to first side plate 58 proximate a forward facing end of first side plate 58. In several embodiments having release latch 31, a trip lever 92 rotatably connected to first side plate 58 is released when release latch 31 is actuated. Rotation of trip lever 92 rotates leg rest lock link 80 to permit extension of leg rest 24 and first and second pantograph linkage sets 34, 35. Trip lever 92 can be continuously biased in each of a retention position (retaining the stowed position of leg rest 24) and a release position (allowing the extension of leg rest 24) by a trip lever biasing element 94 such as a coiled spring, which is connected between trip lever 92 and a trip lever bracket 96. Trip lever bracket 96, similar to bracket 90, can be an integral extension of first side plate 58. When leg rest 24 is released from the stowed position, a manually adjustable 3-position detente cam 98 is provided to permit pre-determining a weight or load that leg rest 24 will support before leg rest 24 is induced to return from the extended position to the stowed position.

The stop drive links 82 rotate relative to the lock links 80, 81. The additional rotation of stop drive links 82 allow for improved positioning of the first and second pantograph linkage sets 34, 35 to provide a linkage layout allowing a close-to-center three (3) pivot point function of the stop drive links 82 and actuation mechanism 32. In several embodiments, the lock links 80, 81 rotate approximately 90 degrees and the stop drive links 82 rotate approximately 120 degrees. The additional 30 degrees of rotation of the stop drive links 82 provide for the 3 pivot point function of the first and second pantograph linkage sets 34, 35, and permit the use of the 3-position detente cam 98 to temporarily "adjust" or fix the location of first and second pantograph linkage sets 34, 35 to the centered position. The lock links 80, 81 provide a journal bearing surface for the stop drive links 82 to rotate on. The external journal bearing of the lock links 80, 81 interact with the first and second side plates 58, 60 and also interact with the stop drive links 82. The external journal of the lock links 80, 81 also provide a surface for a spring clip (not shown) that locates the stop drive links 82 relative to the first and second side plates 58, 60 and the drive rod 78. An internal journal bearing of the stop drive links 82 provide a large bearing contact with the lock links 80, 81 to prevents distortion of the stop drive links 82 during force application. The interaction of the stop drive links 82 and the lock links 80, 81 permits an in-line layout of actuation mechanism 32 and reduces the amount of offset required for travel of the first and second pantograph linkage sets 34, 35 of actuation mechanism 32.

Figure 4:
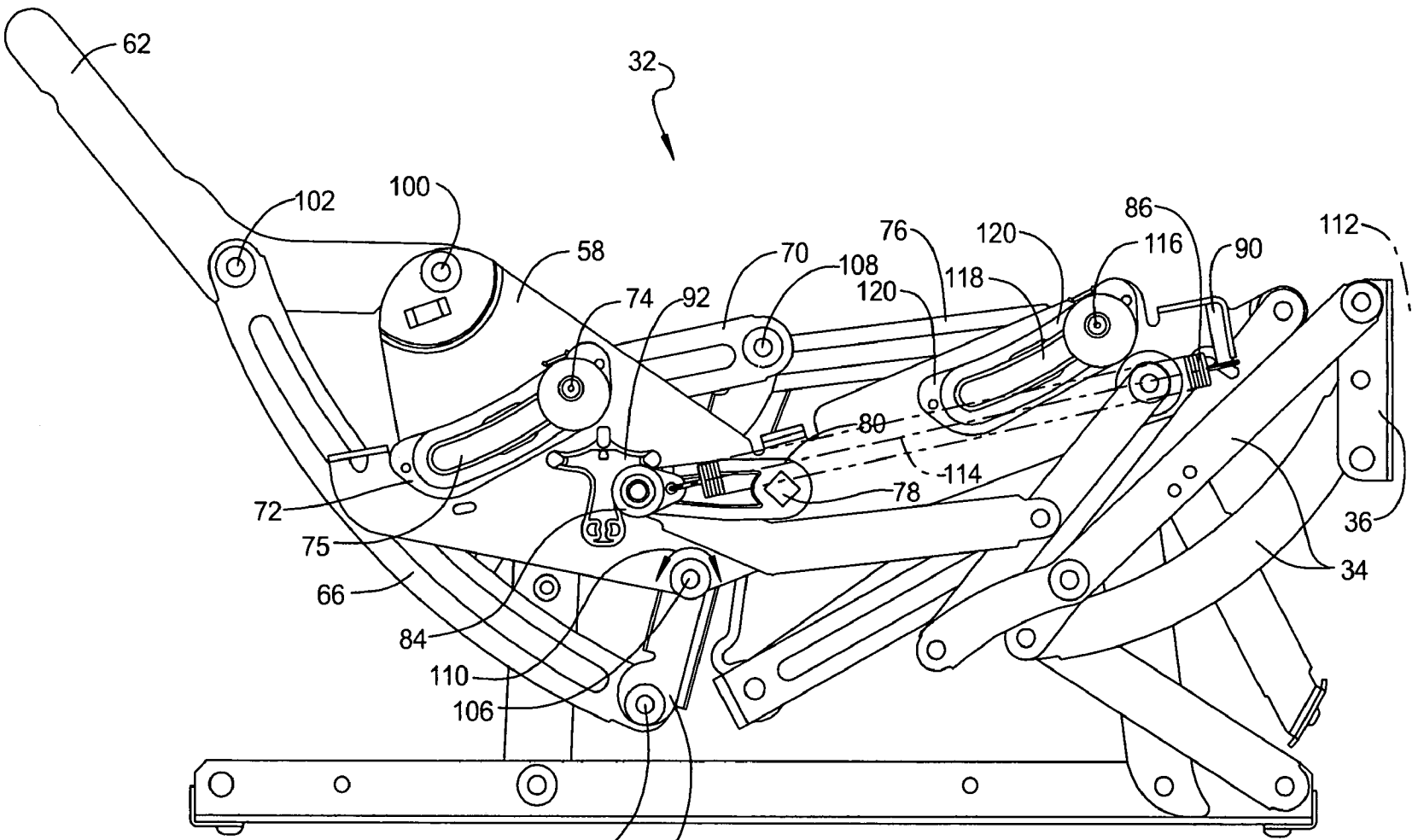
FIG. 4 is a side elevational view of the actuation mechanism of FIG. 3.

Referring now to FIG. 4, the "pre-reclining" function operates as follows. First seat back support element 62 is rotatably coupled to first side plate 58 by a pin 100 and to one end of first actuation link 66 by a pin 102. First actuation link 66 is rotatably coupled at a second end to first flanged link 68 by a pin 104. First flanged link 68 is rotatably coupled to first side plate 58 with a pin 106 and at a second end to first connecting link 70 by a pin 108. Pins 100, 102, 104, 106, and 108 are fasteners such as, but not limited to spin rivets, bolts, or the like. Part numbers described above refer to the right hand side of actuation mechanism 32, however it is noted similar parts on the left hand side (associated with second side plate 60) are connected and will move in a corresponding manner.

When an occupant seated on furniture member 10 leans backward (to the left as viewed in FIG. 4), their weight or force is transferred through first seat back support element 62 and first actuation link 66 to first flanged link 68 and from first flanged link 68 to connecting link 70. First flanged link 68 can rotate with respect to pin 106 about an arc of rotation 110. As first flanged link 68 rotates about pin 106, first rear motion pin 74, which is connected to first connecting link 70, slides within the elongated slot 75 of first rear motion insert 72. Because first rear motion pin 74 is directly linked by first cross link 76 to a first forward motion pin 116, as first rear motion pin 74 slides in elongated slot 75, first forward motion pin 116 slides within an elongated slot 118 of a first forward motion insert 120 connected to first side plate 58. The total travel distance of first flanged link 68 when first flanged link 68 contacts an extended portion of stop drive link 82 limits the total angular displacement of seat back 16 during pre-reclining motion. This angular displacement is approximately one third (33%) of the total rotation or angular displacement which seat back 16 can undergo. When the occupant leans forward from the pre-recline position of seat back 16, the weight of the occupant is re-centered substantially forward (to the right as viewed in FIG. 4) of pin 106 which reverses the rotation described above and returns first seat back support element 62 to the upright or non-reclined position. No biasing device or element is provided or required to assist the pre-recline function. First side plate 58 therefore can globally move forward and rearward with respect to first and second lateral frame members 42, 44, first rear support arm 52 and first cross link 76.

With further reference to FIG. 4, in the leg rest stowed position, a plane of action or centerline 112 of biasing element 86 is maintained above a centerline 114 of drive rod 78. This over-center position of the biasing element 86 is maintained by over-center toggle 84 which can freely rotate at its connection point with leg rest lock link 80. The biasing force of biasing element 86 is therefore functional to lock or maintain the stowed position of leg rest 24. When trip lever 92 is rotated clockwise as viewed in FIG. 4 by actuation of release latch 31, trip lever 92 forces leg rest lock link 80 downward. When leg rest lock link 80 rotates far enough to reposition the centerline 112 of biasing element 86 below the centerline 114 of drive rod 78, the biasing force of biasing element 86 acting through over-center toggle 84 rotates leg rest lock link 80 counterclockwise as viewed in FIG. 4 with respect to drive rod 78, allowing extension of leg rest 24. As first and second pantograph linkage sets 34, 35 extend (to the right as viewed in FIG. 4), first rear motion pin 74 and first forward motion pin 116 rotate within their corresponding elongated slots 75, 118.

First rear motion insert 72 and first forward motion insert 120 can be provided of an elastomeric material such as a polyamide material. In some embodiments, a nylon 6-6 or an ultra high molecular weight material can be used. The polymeric material reduces sliding friction of first rear motion pin 74 or first forward motion pin 116, which also eliminates the need to lubricate these sliding connections.

Figure 5:
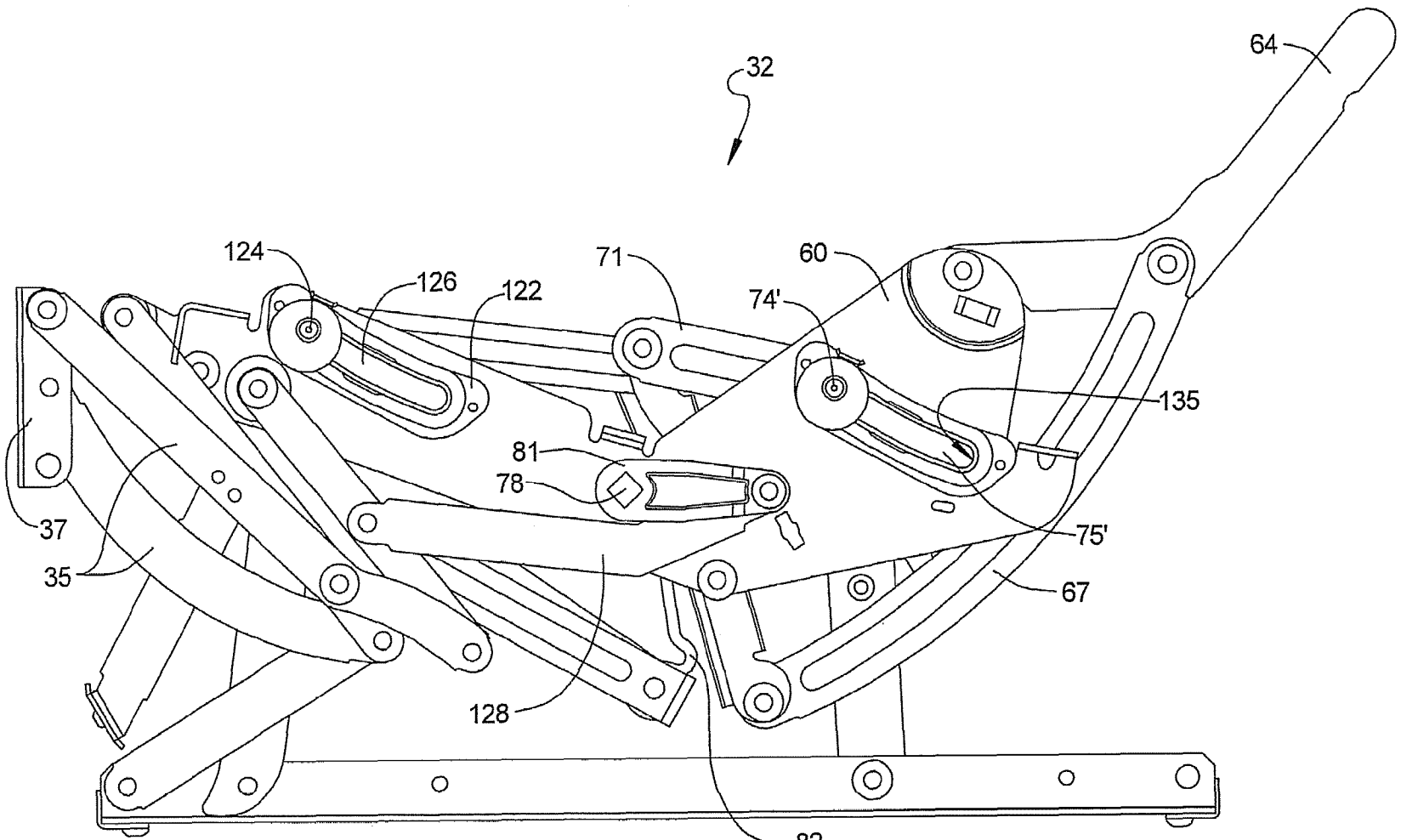
FIG. 5 is a side elevational view of the actuation mechanism of FIG. 3 and opposite to the view of FIG. 4.

Referring generally to FIG. 5, components on a left hand or second side of actuation mechanism 32 include a second forward motion insert 122, similar to first forward motion insert 120. A second forward motion pin 124 is slidably received in an elongated slot 126 of second forward motion insert 122, similar to first forward motion pin 116. Second leg rest lock link 81 is not retained by a comparable trip lever to trip lever 92 on this side, and therefore no over-center toggle or biasing element is provided on this side. Second leg rest lock link 81 is connected at one end to drive rod 78 and at a second end is rotatably pinned to an extension link 128. As drive rod 78 rotates, second leg rest lock link 81 operatively extends extension link 128 toward the left as viewed in FIG. 5.

Figure 6:
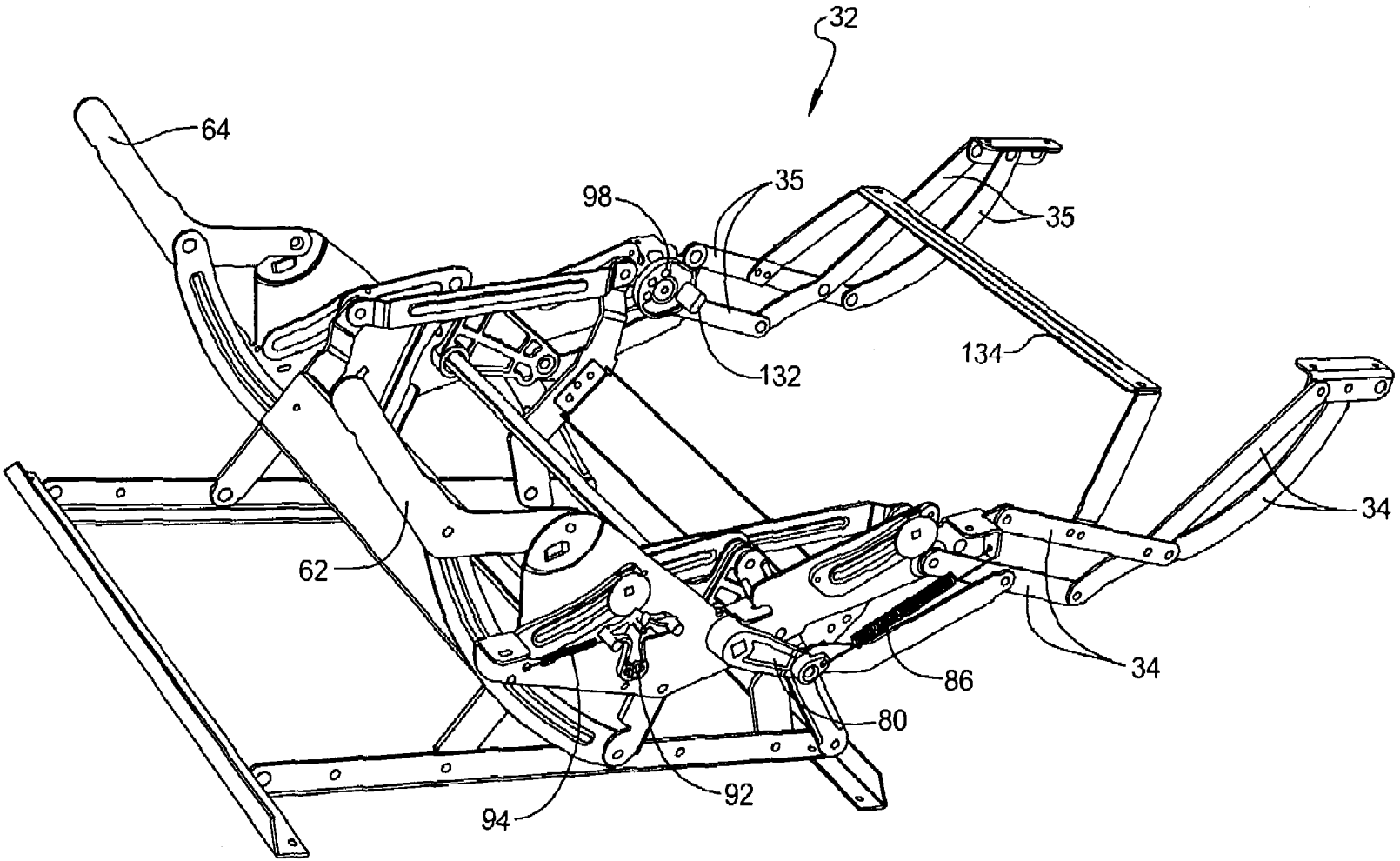
FIG. 6 is a rear perspective view of the actuation mechanism of the present disclosure shown in an extended position.

As best seen in reference to FIG. 6, a fully extended leg rest and fully upright back support condition for actuation mechanism 32 is provided. In this position, first and second seat back support elements 62, 64 are positioned corresponding to a fully upright seat back 16. First leg rest lock link 80 is rotated substantially 120° from its "locked" position when the actuation mechanism 32 is in the stowed position. Biasing element 86 provides an assisting biasing force to enable first and second pantograph linkages 34, 35 to fully extend. The stop drive links 82 in combination with biasing element 86 and cam 98 control the leverage support of the extended footrest by varying the fully extended position of the mechanism. The stop drive links 82 also transfer occupant weight into rotational torque of the drive rod 78 through force transmittal from the lateral frame member 44 providing a three pivot point layout whereby the pivot points are substantially in-line creating maximum support leverage for support of the occupant's legs and feet. Biasing element 94 provides a preload, or assist force to trip lever 92 such that when release latch 31 is actuated, biasing element 94 biases trip lever 92 in a generally counterclockwise direction as viewed in reference to FIG. 6. This biasing force returns trip lever 92 toward its normal position after rotating to release first leg rest lock link 80 to rotate away from the stowed position and into the extended position shown.

In several embodiments of the present disclosure, cam 98 can also include an extension element 132. Extension element 132 is provided to manually grasp and rotate cam 98 between any of three detente positions which will be discussed in greater detail in reference to FIGS. 23 through 25. A leg support bar assembly 134 can also be provided with actuation mechanism 32. Leg support bar assembly 134 is only supported to individual right hand and left hand members of first and second pantograph linkage sets 34, 35. Because leg support bar assembly 134 is fastened to leg support 22, as first and second pantograph linkage sets 34, 35 extend outwardly, leg support bar assembly 134 passively extends with leg rest 24. No additional support or linkages are required for leg support bar assembly 134 because of the passive extension capability provided.

Figure 7:
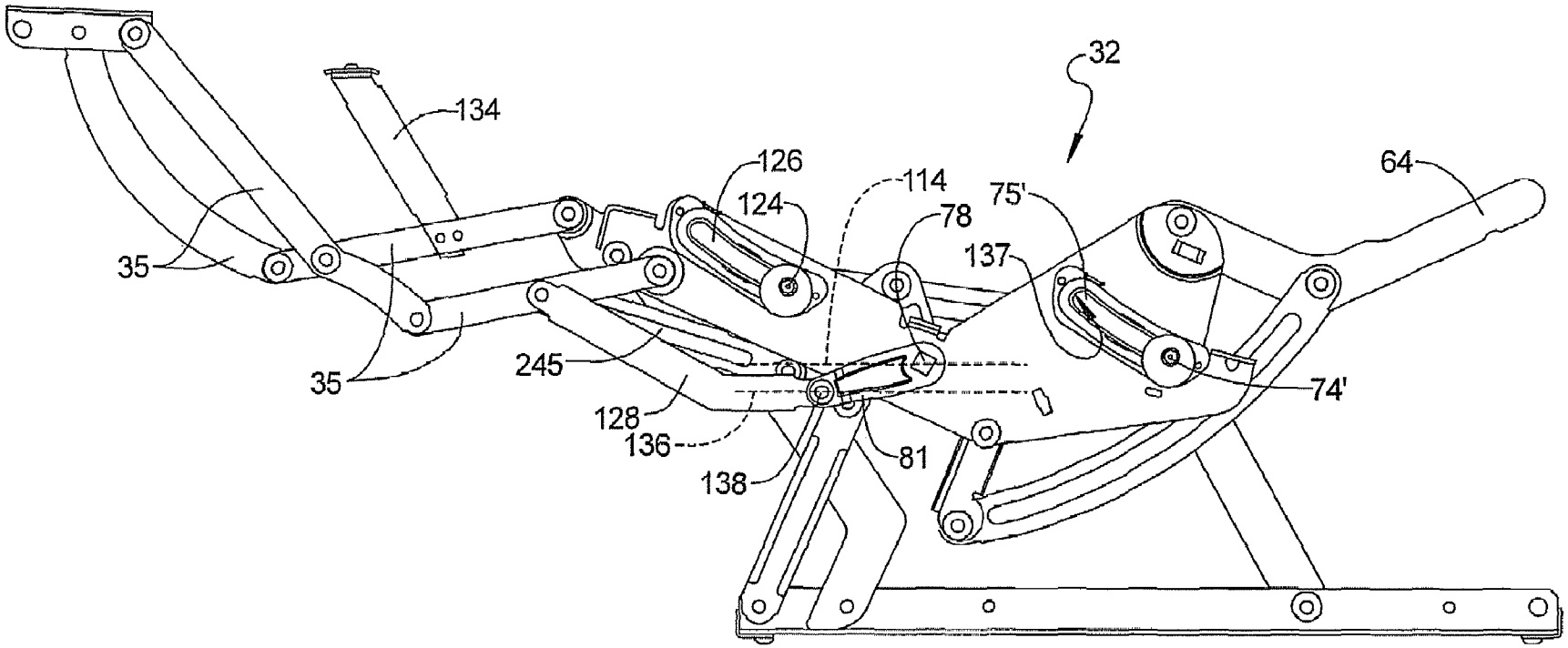
FIG. 7 is a side elevational view of the actuation mechanism of FIG. 6.

Referring now to FIG. 7 and again to FIG. 5, a left hand or second side view of actuation mechanism 32 identifies the relationship between the rear and forward motion pins in their respective elongated slots. Second rear motion pin 74' in the fully extended position of actuation mechanism 32 abuts a stop end 135 shown in FIG. 5 of elongated slot 75' .At the same time, second forward motion pin 124 also abuts a rearward facing stop end of elongated slot 126. Second leg rest lock link 81 has rotated from the stowed position to the rotated extended position as drive rod 78 rotates. Extension link 128 is rotatably coupled to second leg rest lock link 81 using a pin 138. In the fully extended position, a pin horizontal axis plane 136 defined through pin 138 is positioned below centerline 114 of drive rod 78. To leave the leg rest fully extended position, seat back 16 must first be rotated back to its upright position reversing the pre-recline motion. Second rear motion pin 74' and forward motion pin 124 slide in their respective elongated slots 75' and 126 during this motion. When seat back 16 has returned completely to the upright position, first and second rear motion pins 74, 74' and each of first forward motion pin 116 and second forward motion pin 124 are positioned within their respective elongated slots 75, 75' , 118 or 126 at opposite ends 137 from the pre-recline position. Once seat back 16 is returned to the upright position, the retention force of cam 98 is overcome by downwardly directing the leg weight of the occupant on leg rest 24. This force initiates rotation of second leg rest lock link 81 back toward the stowed position. As first and second pantograph linkage sets 34, 35 return to the stowed position, first and second rear motion pins 74, 74' and each of first forward motion pin 116 and second forward motion pin 124 translate within their respective elongated slots.

Figure 8:
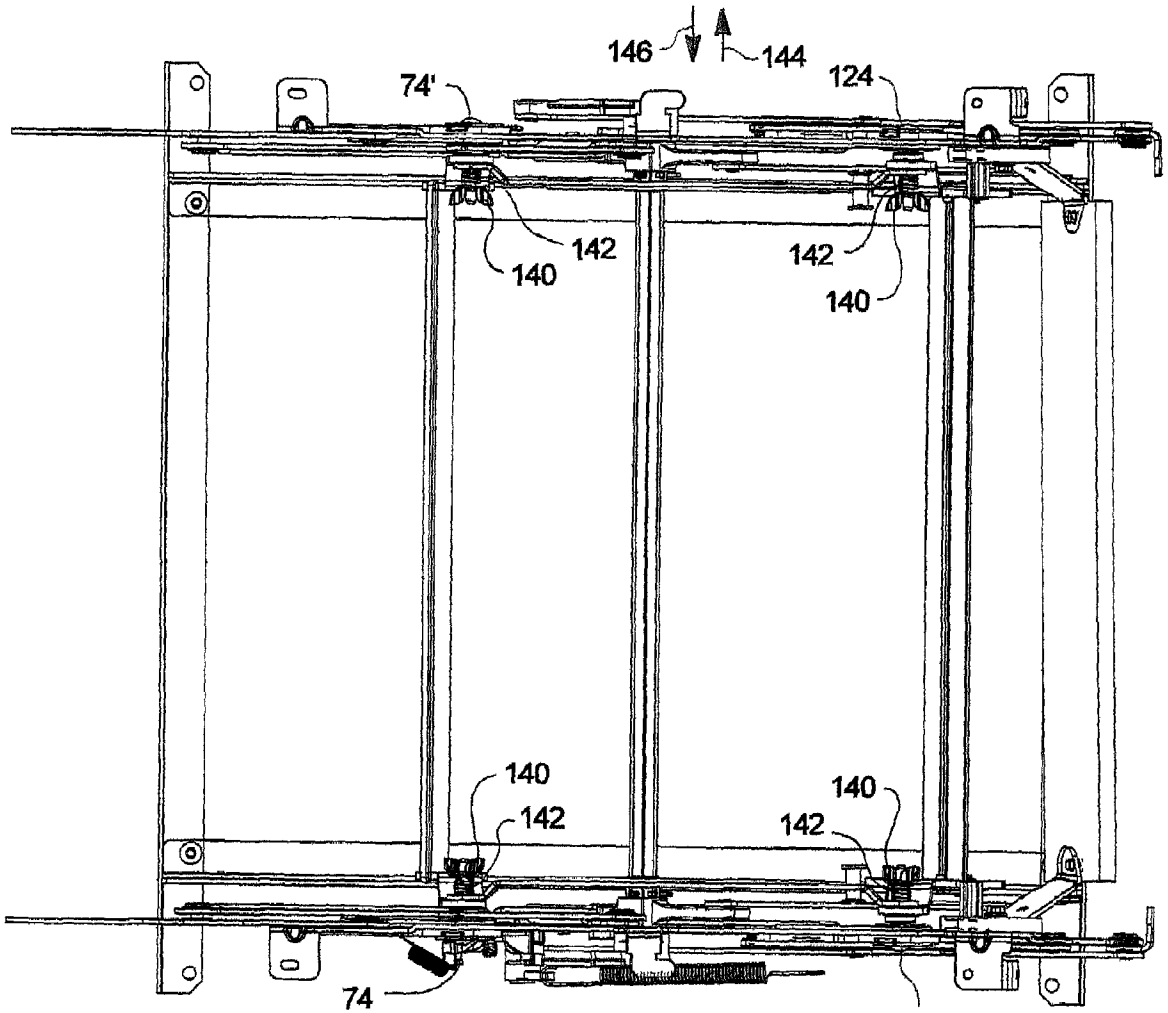
FIG. 8 is a top plan view of the actuation mechanism of FIG. 3.
Figure 17:
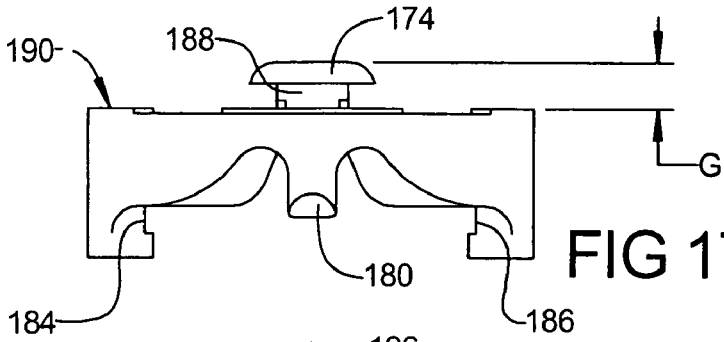
FIG. 17 is a top plan view of the trip lever of FIG. 15.

As best seen in reference to FIG. 8, each of the first and second rear motion pins 74, 74', the first forward motion pin 116, and the second forward motion pin 124 can be fastened using a retaining element 140 such as a wing nut. A biasing element 142 is positioned between the retaining element 140 and various link members joined by the motion pins. The purpose of biasing elements 142 is to provide adjustability to either increase or decrease the friction between the various members of actuation mechanism 32 as they extend or retract, which therefore also controls the mechanism speed and any assist effort required by the occupant. Each of the retaining elements 140 provides a retention force in either a first or second load directional path 144, 146. A further benefit of retaining elements 140 occurs when the furniture members are shipped. It is common for furniture members 10 to be shipped having either a first or second side plate 58, 60 oriented in a downward facing direction. If retaining elements 140 are not used, and a hard connection or hard fastened joint is created, loads imparted on actuation mechanism 32 and furniture member 10 during shipment can damage the various members of actuation mechanism 32. When biasing elements 142 are used, however, these elements act as shock absorbers to diminish the load applied in either of the first or second load directional paths 144 or 146.

Referring now generally to FIGS. 9 through 11, each of first and second leg rest lock links 80, 81 include a lock link body 148 created from a polymeric material such as a polyamid material which provides low friction resistance and good wear resistance. Drive rod 78 is received in a receiving aperture 150 at a first end of lock link body 148. At a second end of lock link body 148, a toggle alignment aperture 152 is provided. A fastener such as a spin rivet (not shown) can be inserted through toggle alignment aperture 152 to join over-center toggle 84 to either first or second leg rest lock link 80, 81. Also located at the first end of lock link body 148 is a reinforced portion 154 from which a cylinder end 156 extends substantially transverse to the lock link body 148. Cylinder end 156 is sized to slidably fit and rotate within an aperture (not shown) provided in either first or second side plate 58, 60. One or more retention device apertures 158 can be provided in cylinder end 156. The purpose for retention device apertures 158 is to provide a locking device such as a lock wire or set screw to physically retain drive rod 78 within cylinder end 156 and reinforced portion 154. Receiving aperture 150 is configured to suit the outer geometry of drive rod 78. In the example shown in FIG. 11, drive rod 78 is substantially square in shape, therefore receiving aperture 150 is provided with four substantially equidistant length sides to engage the sides of drive rod 78. One of the receiving walls or sides of receiving aperture 150 is oriented at an angle a with respect to a longitudinal axis of lock link body 148. In several embodiments for the drive rod 78 having a substantially square shape, angle $\alpha$ is substantially equal to 45°.

Referring now generally to FIGS. 12 and 13, over-center toggle 84 includes a toggle body 160 having a through aperture 162 substantially centrally positioned within toggle body 160. Toggle body 160 is substantially circular having a diameter "A". Through aperture 162 has a diameter "B". Diameter "B" is substantially equal to a diameter of the pin or fastener inserted in through aperture 162 and toggle alignment aperture 152 of first or second leg rest lock links 80, 81. Over-center toggle 84 is also created from a polymeric material similar to the material used for first and second leg rest lock links 80, 81. An arm 164 extends from toggle body 160 such that a total length "C" of over-center toggle 84 is provided. A biasing element receiving aperture 166 is positioned at a dimension "D" with respect to a centerline of through aperture 162. Dimension "D" is predetermined to maintain sufficient wall thickness in arm 164 surrounding biasing element receiving aperture 166 to accommodate the biasing force provided by biasing element 86. Toggle body 160 also has a total height "E", and arm 164 has a total depth "F". In several embodiments of the present disclosure, total length "C" is approximately 1.25 inches (3.17 cm), dimension "D" is approximately 0.56 inches (1.42 cm), height "E" is approximately 0.42 inches (1.07 cm), and depth "F" is approximately 0.21 inches (0.53 cm).

Referring now to FIGS. 14 through 18 and with further reference to FIGS. 4 and 6, trip lever 92 can be constructed of a polymeric material similar to first and second leg rest lock links 80, 81 to reduce friction between operating parts and eliminate the need for lubrication. Trip lever 92 includes a trip lever body 170 having a head 172. An engagement element 174 extends from a rear face of trip lever body 170 which engages first side plate 58. Head 172 further includes a first rod 176 and a second rod 178 disposed at opposite sides of head 172. A hook member 180 is also provided substantially centrally positioned between each of the first and second rods 176, 178. First and second rods 176, 178 define a "cross-shape" which permits compounding the amount of travel of trip lever 92 about engagement element 174, to activate the lock link 80 with limited stroke of a cable (not shown) connected between the release latch 31 and hook member 180. First rod 176 is biased by biasing element 94 for rapid release of trip lever 92.

Trip lever body 170 further includes a perimeter wall having a wall thickness "F". Hook member 180 provides a cable engagement surface 182. First rod 176 also includes a recessed portion 184 and second rod 178 includes a recessed portion 186. Recessed portion 184 is provided to retain an end of biasing element 94 which is engaged with first rod 176. Recessed portion 186 is provided to retain an end of biasing element (not shown) which is engaged with second rod 178 to normally bias trip lever 92 in contact with lock link 80. Engagement element 174 extends from a rear side of trip lever 92. A neck portion 188 provides an extension for engagement element 174 from the rear side which includes a length "G" which is dimensioned substantially equal to a thickness of first side plate 58. First side plate 58 is therefore engaged between engagement element 174 and a combined plate engagement surface 190 allowing trip lever 92 to rotate with respect to first side plate 58.

Figure 18:
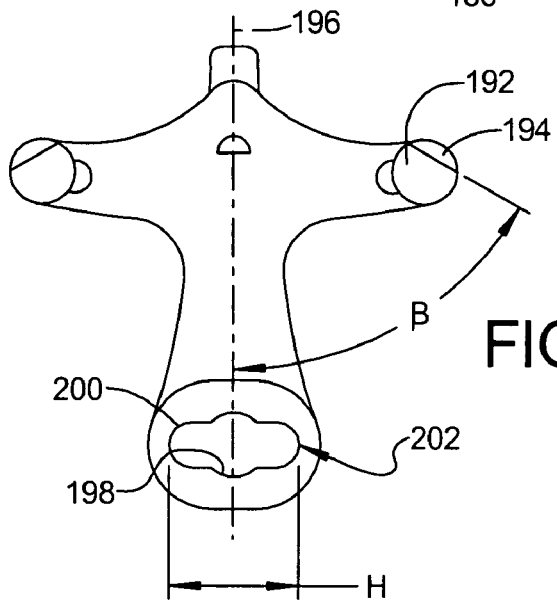
FIG. 18 is a rear elevational view of the trip lever of FIG. 14.
Figure 16:
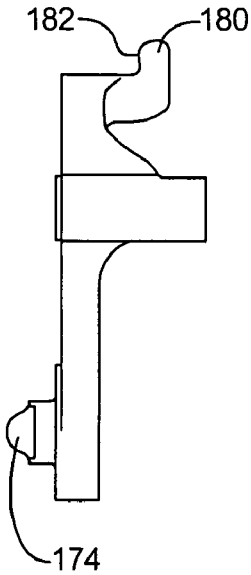
FIG. 16 is a side elevational view of the trip lever of FIG. 15.
Figure 15:
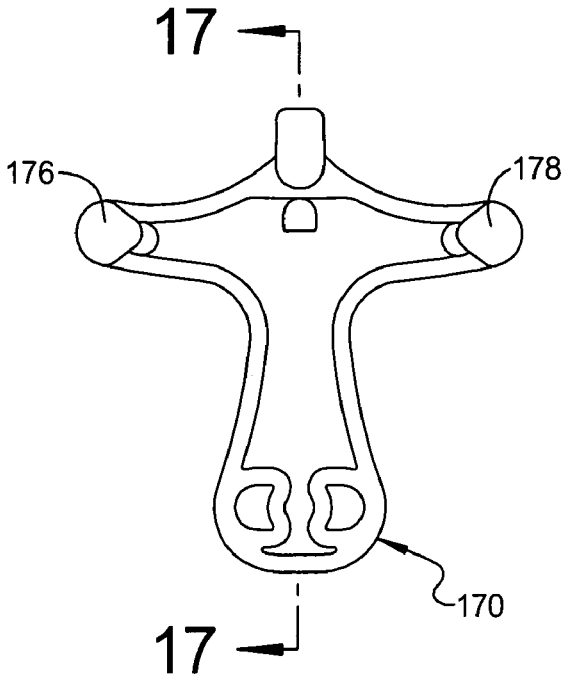
FIG. 15 is a front elevational view of the trip lever of FIG. 14.
Figure 20:
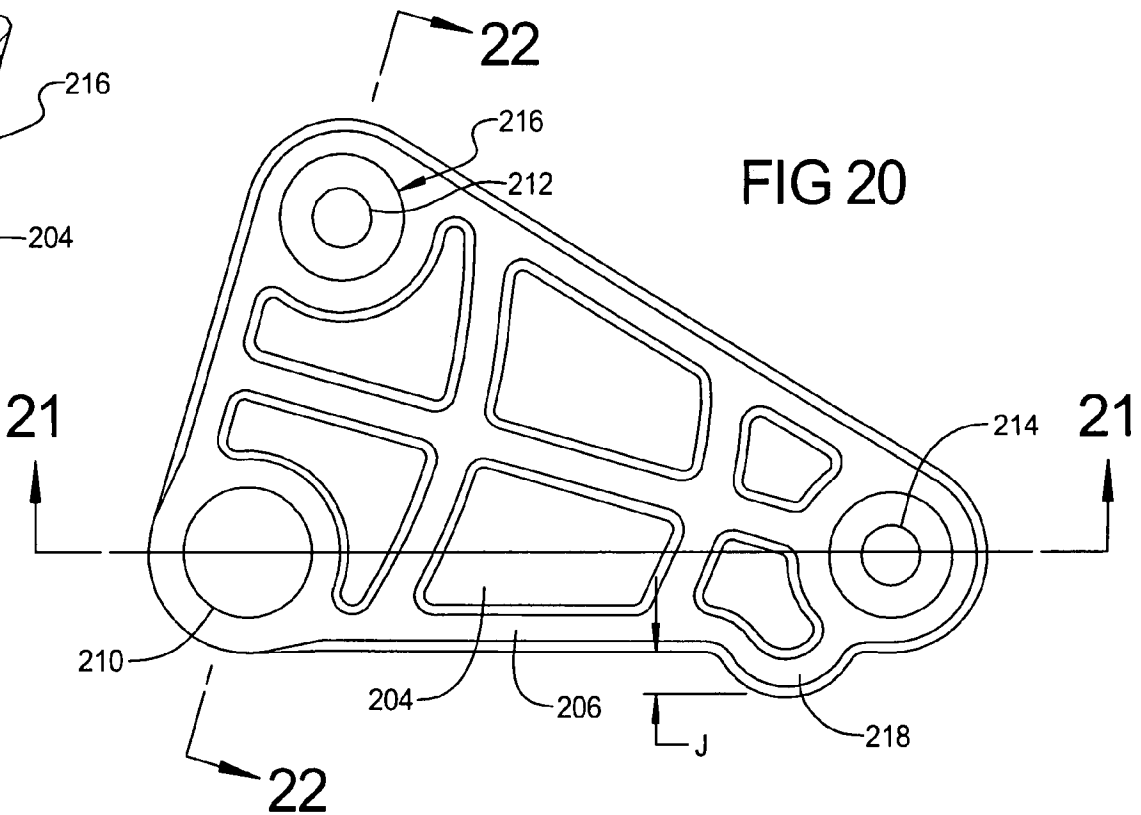
FIG. 20 is a side elevational view of the stop drive element of FIG. 19.
Figure 21:
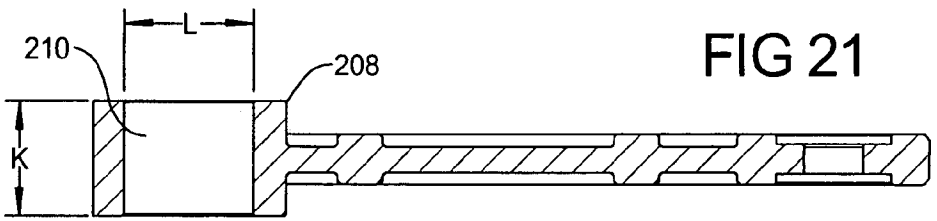
FIG. 21 is a cross sectional view taken at section 21-21 of FIG. 20.
Figure 22:
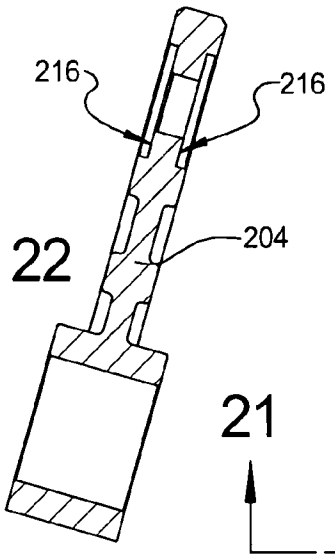
FIG. 22 is a cross sectional view taken at section 22-22 of FIG. 20.

On the rearward facing side of trip lever 92 shown in FIG. 18, each of the first and second rods 176, 178 include an end face 192 and a raised surface 194. Raised surface 194 is oriented at an angle P with respect to a longitudinal axis 196 of trip lever body 170. Engagement element 174 is further configured as shown to include a center spherical portion 198 and each of a first and a second side spherical portion 200, 202. A "compound engagement" is created as follows. Engagement element 174 is inserted into a correspondingly shaped aperture (not shown) in first side plate 58 which in several embodiments is oriented substantially 90° to the desired orientation of trip lever 92. Trip lever 92 is then rotated approximately 90° about center spherical portion 198 until the extending portions of first and second side spherical portions 200, 202 engage first side plate 58. First and second side spherical portions 200, 202 therefore provide a retention capability for trip lever 92. A total width "H" is provided for engagement element 174 which is sized to be slidably received in the corresponding aperture of first side plate 58. Because of the geometry of engagement element 174, additional fasteners are not required to mount trip lever 92 to first side plate 58.

Referring now to FIGS. 19 through 22, stop drive links 82 are also created from a polymeric material similar to first and second leg rest lock links 80, 81. Stop drive links 82 include a body 204 having a perimeter raised rib 206 and a cylinder portion 208. A through aperture 210 is centrally disposed through cylinder portion 208. Through aperture 210 is sized to receive a cylindrical sleeve positioned at an end of drive rod 78. First and second pin apertures 212, 214 are also provided with stop drive links 82. First and second pin apertures 212, 214 provide for pinned connections to individual ones of the linkages associated with actuation mechanism 32. As best seen in reference to FIGS. 20 through 22, a countersink 216 is provided coaxially aligned with each of first and second pin apertures 212, 214. Countersinks 216 allow for a flush fit of a fastener head such as a spin rivet head when the fasteners are inserted through the pin apertures. An extending portion or stop boss 218 having an extension dimension "J" is positioned proximate to pin aperture 214. As previously identified, stop boss 218 acts as a travel limiter for first flanged link 68 during pre-recline motion. Cylinder portion 208 has a total height "K" and through aperture 210 has a through aperture diameter "L". In several embodiments of the present disclosure, height "K" is approximately 0.75 inches (1.90 cm), and diameter "L" is approximately 0.85 inches (2.16 cm).

Figure 23:
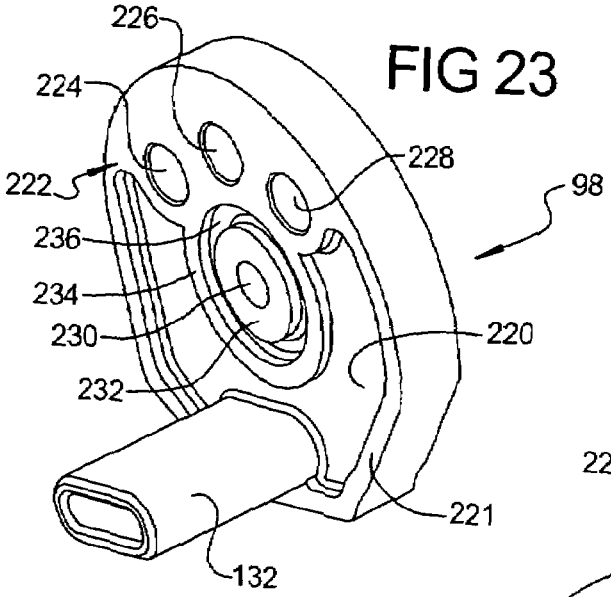
FIG. 23 is a perspective view of a cam of the present disclosure.
Figure 24:
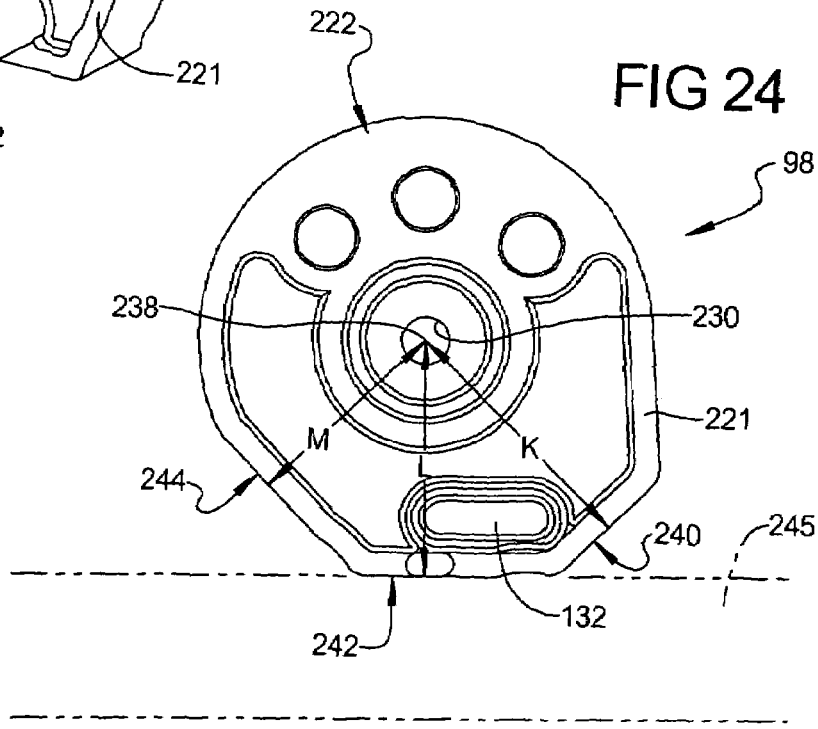
FIG. 24 is a front elevational view of the cam of FIG. 23.
Figure 25:
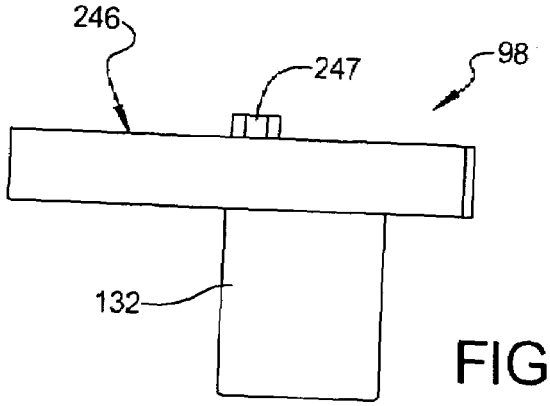
FIG. 25 is a top plan view of the cam of FIG. 24.

Referring now generally to FIGS. 23 through 25, cam 98 includes a recessed body face 220 and a main body face 222. A first, second and third detente aperture 224, 226, 228 are created in main body face 222. Each of the first, second and third detente apertures 224, 226, 228 provide for engagement with a detente member (not shown) extending from second side plate 60. A pin aperture 230 is provided to rotatably connect cam 98 to second side plate 60 using a fastener element such as a bolt or rivet. A raised inner ring 232 is located proximate to pin aperture 230 and a raised outer ring 234 is spaced outwardly from raised inner ring 232, creating a biasing element retention slot 236. A biasing element (not shown) such as a coiled spring can be positioned and retained within biasing element retention slot 236 providing a tensioning force to bias cam 98 against second side plate 60. The biasing force can be adjusted making rotation of cam 98 easier or more difficult when changing between the various detente positions provided by first, second and third detente apertures 224, 226, 228. Cam 98 is therefore rotatable about an aperture centerline 238 of pin aperture 230 by manually grasping extension element 132 and applying enough rotational force to overcome any biasing force of the biasing element positioned within biasing element retention slot 236.

As further shown in reference to FIG. 24, cam 98 also includes each of a first, second, and third cam face 240, 242, 244. Each of the first, second and third cam faces 240, 242, 244 are positioned sequentially closer to aperture centerline 238. As cam 98 is rotated to the various detente positions, one of the first, second and third cam faces 240, 242, 244 contacts a cam link 245 providing an increasing extension length of first and second pantograph linkage sets 34, 35 . A weight bearing load of leg rest 24 increases as cam 98 is repositioned from contact with first cam face 240 up to contact with third cam face 244. A dimension "K" is provided between aperture centerline 238 and first cam face 240. A dimension "L" is provided between aperture centerline 28 and second cam face 242. A dimension "M" is provided between aperture centerline 238 and third cam face 244. Dimension "M" is greater than dimension "L" which is greater than dimension "K", therefore allowing a greater extension of leg rest 24 when third cam face 244 is in contact with cam link 245 compared to either second or first cam faces 242, 240 respectively. As also shown in reference to FIG. 25, a cam mounting face 246 provides an alignment tab 247 extending substantially transverse to recessed body face 220. Alignment tab 247 provides for improved alignment of cam 98 when cam 98 is originally installed on second side plate 60.

Figure 27:
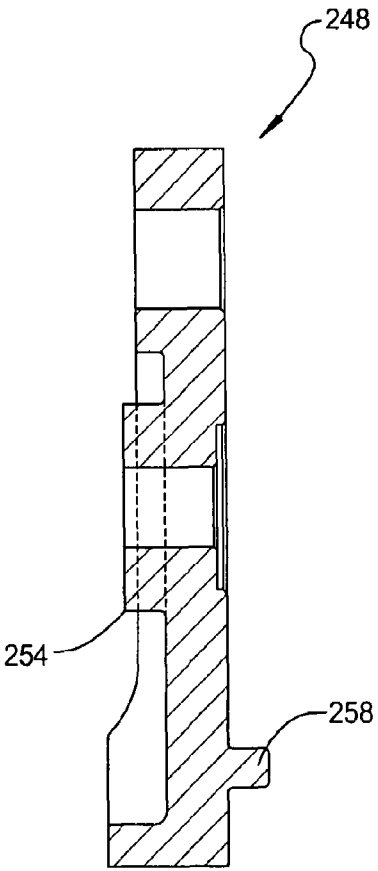
FIG. 27 is a cross sectional view taken at section 27-27 of FIG. 26.
Figure 26:
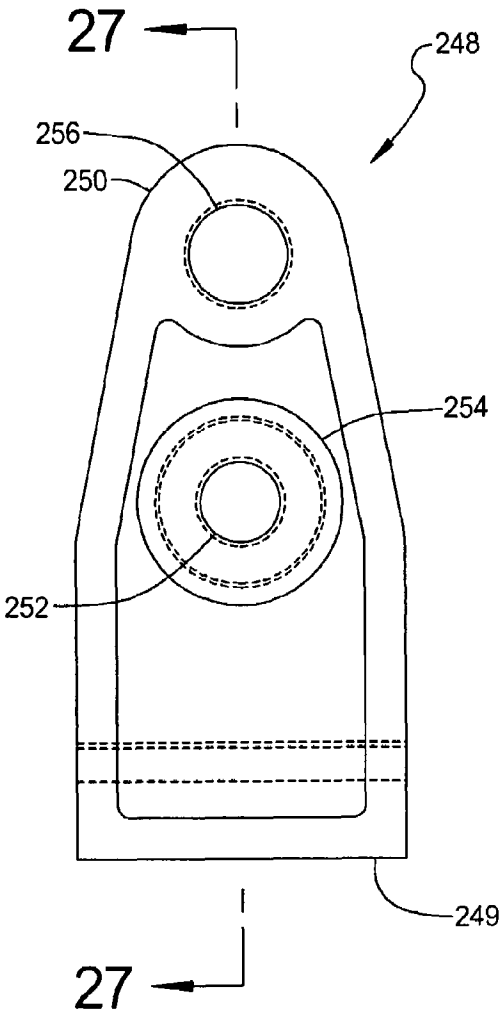
FIG. 26 is a front elevational view of further embodiments of a cam of the present disclosure.

Referring now to FIGS. 26 and 27, in other embodiments of the present disclosure, a non-adjustable cam 248 can be used in place of cam 98. Non-adjustable cam 248 provides only a single face to engage cam link 245. Non-adjustable cam 248 further includes a cam body 250 having a pin aperture 252 and a raised area 254 coaxially aligned with pin aperture 252 providing a bearing surface for a fastener to engage. A detente engagement aperture 256 is also provided which serves a similar function to any one of the first, second or third detente apertures 224, 226, 228, allowing engagement with the detente element extending from second side plate 60. Similar to cam 98, non-adjustable cam 248 provides an alignment tab 258.

Referring now to FIGS. 28 and 29, the installation of rear cross brace 56 to second rear support arm 54 is shown. Front cross brace 50 is installed in like manner and will therefore not be further discussed herein. Rear cross brace 56 includes a brace web 260 having each of a first and a second flange 262, 263 extending transversely therefrom at opposite ends of brace web 260, thereby forming a substantially U-shaped channel. A portion of each of first and second flanges 262, 263 is removed and an end wall 264 is created by bending a portion of brace web 260 substantially transverse to its normal configuration. A partial cavity 266 is created between first flange 262 and end wall 264. Partial cavity 266 has a cavity spacing "N". Cavity spacing "N" substantially equals to a thickness of second rear support arm 54. Second rear support arm 54 can therefore be slidably engaged within partial cavity 266 such that both an end face 269 of each of first and second flanges 262 and 263 and end wall 264 oppositely abut against second rear support arm 54. A single fastener 268 is then inserted through end wall 264 and second rear support arm 54 to fastenably engage the assembly. By using partial cavity 266 created at both ends of rear cross brace 56 as well as front cross brace 50, only a single fastener is required at the ends of the cross braces and significant stiffness is provided to resist side to side deflection of actuation mechanism 32. Redundant or second fasteners are therefore eliminated for the front and rear cross braces 50, 56 of the present disclosure.

Figure 30:
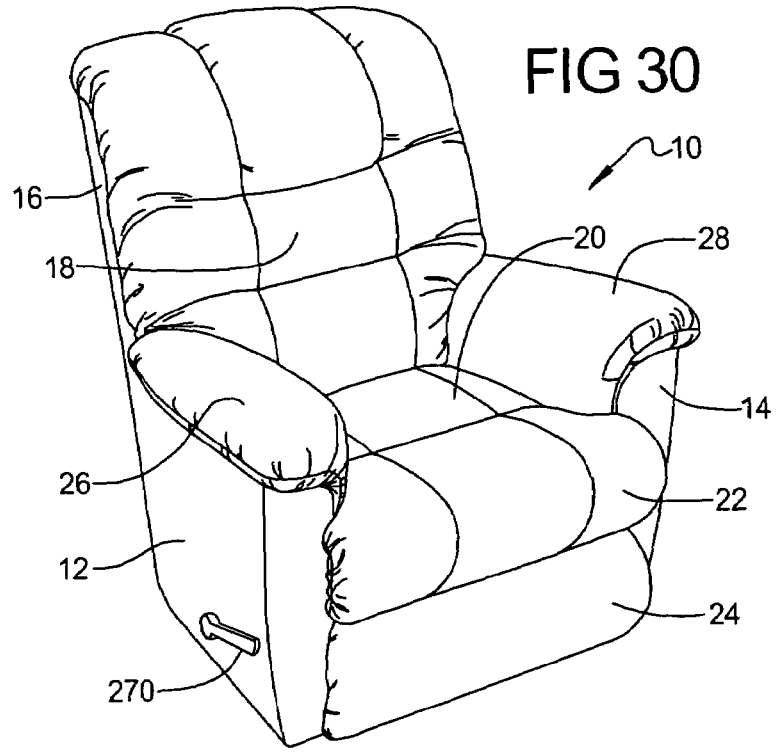
FIG. 30 is a front perspective view of a furniture member similar to FIG. 1 showing a lever arm for actuating the furniture member.
Figure 31:
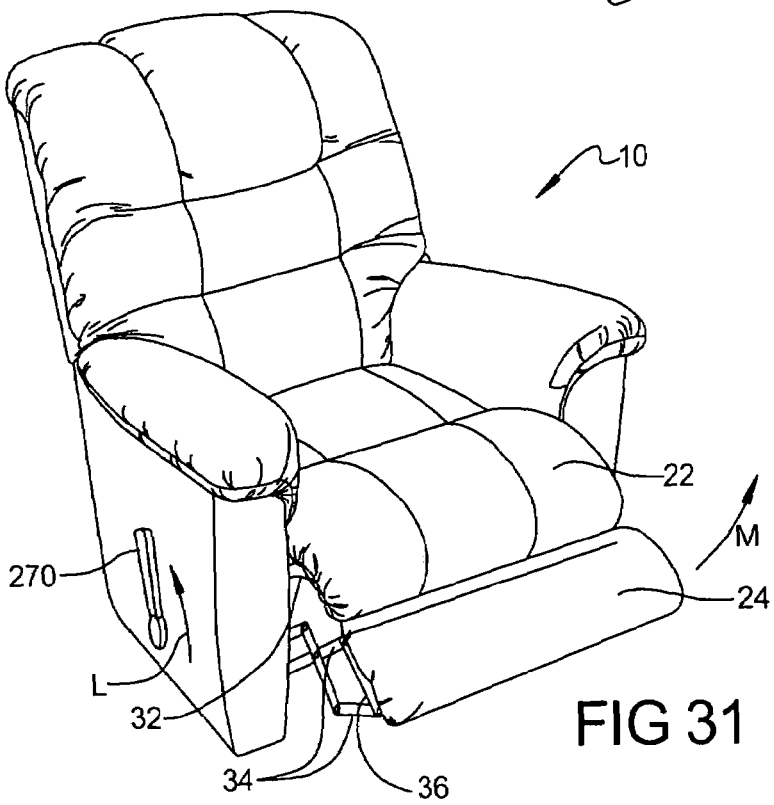
FIG. 31 is a front perspective view of the furniture member of FIG. 31 showing a leg rest assembly in an extended position.

Referring now generally to both FIGS. 30 and 31, in several embodiments of the present disclosure, furniture member 10 can include a lever 270 in place of release latch 31. Lever 270 is rotated in the direction of arc of rotation "L" to extend leg rest 24 about an arc of rotation "M". In those embodiments where lever 270 is used, lever 270 is directly connected to drive rod 78, thereby eliminating the need for trip lever 92 and trip lever biasing element 94. Rotation of lever 270 overcomes the over-center bias provided by over-center toggle 84 to allow extension of leg rest 24.

An in-line linkage mechanism or actuation mechanism of the present disclosure provides several advantages. By providing motion inserts having elongated slots, the linkage of actuation mechanism 32 provides a pre-reclining function for the seat back which requires no biasing element and returns by weight of the occupant to an upright position. The frame structure of the actuation mechanism of the present disclosure also provides a rigid structural cross brace design requiring only a single fastener for installation at opposite ends of the cross braces thereby eliminating weight while providing side to side rigidity for the actuation mechanism. The release mechanism using the trip lever and over-center toggle of the present disclosure provides for smooth operation of the actuation mechanism due to the polymeric material selected for these applications, which eliminates the need for lubrication of the sliding or rotating elements. The cam design of the present disclosure also permits an adjustment to be made for heavier or lighter weight occupants of the furniture member to balance the amount of load required to return the leg rest to the stowed position for occupants of varying weights and sizes.

The present disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A furniture member actuation mechanism, comprising:

opposed first and second side plates;

first and second members, the first member connected to the first side plate and the second member connected to the second side plate, each member having an elongated slot including a first and second end;

first and second connecting links, the first connecting link connected to the first side plate and the second connecting link connected to the second side plate;

a first pin connected to the first connecting link and slidingly received in the elongated slot of the first member;

a second pin connected to the second connecting link and slidingly received in the elongated slot of the second member;

first and second seat back support elements, the first element rotatably coupled to the first side plate and the second element rotatably coupled to the second side plate, the first and second seat back support elements rotatable from a fully upright upright position to a fully reclined position;

wherein a rearward force applied by an occupant of the furniture member to both the first and second seat back support elements operates to create a pre-recline position of the seat back support elements defined as a rotation of the seat back support elements from the fully upright to less than the fully reclined position with the first and second pins sliding within the elongated slots away from contact with a first end defining the fully upright position and toward a second end of the elongated slot of both the first and second members in the pre-recline position, and a weight of the occupant when the rearward force is removed operates to return the seat back support elements to a pre-rotation position having the first and second pins sliding back to the first end of the elongated slots of the first and second members.

2. The actuation mechanism of claim 1, further comprising a substantially rectangular shaped frame including first and second lateral members and first and second transverse members coupled to the first and second lateral members.

3. The actuation mechanism of claim 2, further comprising:

a first forward oriented link member and a first rearward oriented link member both connecting the first side plate to the first lateral member, the first pin inserted through the elongated slot of the first member being further inserted through the first rearward oriented link member to slidably couple the first rearward oriented link member to the first side plate; and a second forward oriented link member and a second rearward oriented link member both connecting the second side plate to the second lateral member, the second pin inserted through the elongated slot of the second member being further inserted through the second rearward oriented link member to slidably couple the second rearward oriented link member to the second side plate.

4. The actuation mechanism of claim 3, further comprising:

a first activation link rotatably coupled to the first side plate;

a first flanged link rotably coupled to the first activation link; and the first connecting link rotatably coupled to the first flanged link and rotatably receiving the first pin.

5. The actuation mechanism of claim 4, further comprising:

a second activation link rotatably coupled to the second side plate;

a second flanged link rotably coupled to the second activation link; and the second connecting link rotatably coupled to the second flanged link and rotatably receiving the second pin.

6. The actuation mechanism of claim 3, further comprising third and fourth members, the third member connected to the first side plate forward of the first member and the fourth member connected to the second side plate forward of the second member, each of the third and fourth members having an elongated slot.

7. The actuation mechanism of claim 6, further comprising:

a third pin inserted through the elongated slot of the third member and the first forward oriented link member to slidably connect the first forward oriented link member to the first side plate; and a fourth pin inserted through the elongated slot of the fourth member and the second forward oriented link member to slidably connect the second forward oriented link member to the second side plate.

8. The actuation mechanism of claim 7, further comprising:

a first cross link receiving the first and third pins and operably connecting the first forward oriented link member to the first rearward oriented link member; and a second cross link receiving the second and fourth pins and operably connecting the second forward oriented link member to the second rearward oriented link member.

9. The actuation mechanism of claim 1, further comprising a drive rod rotatably coupled to both the first and second side plates.

10. The actuation mechanism of claim a 9 further comprising:

a first leg rest support arm connected by a first pantograph linkage set to the drive rod; and a second leg rest support arm connected by a second pantograph linkage set to the drive rod;

wherein rotation of the drive rod is operable to rotate the first and second leg rest support arms between a stowed and an extended position.

11. A furniture member actuation mechanism, comprising:

opposed first and second side plates;

first and second polymeric motion inserts, the first motion insert connected to the first side plate and the second motion insert connected to the second side plate, each motion insert having an elongated slot;

a first pin inserted through the elongated slot of the first motion insert;

a second pin inserted through the elongated slot of the second motion insert;

first and second seat back support elements, the first element rotatably coupled to the first side plate and rotatably linked to the first pin and the second element rotatably coupled to the second side plate and rotatably linked to the second pin;

a drive rod rotatably disposed through both the first and second side plates;

first and second leg rest support arms each connected by a pantograph linkage set to the drive rod; and a cam connected to the second side plate, the cam including a plurality of faces each operable to engage a predetermined link of one of the pantograph linkage sets;

wherein rotation of the drive rod is operable to rotate the first and second leg rest support arms between a stowed and an extended position, the cam being rotatable to adjust an occupant load applied to the leg rest support arms operable to return the leg rest support arms from the extended position to the stowed position.

12. The actuation mechanism of claim 11, wherein the plurality of faces comprise:

a first face spaced at a first dimension from a mounting aperture of the cam;

a second face spaced at a second dimension from the mounting aperture, the second dimension less than the first dimension; and a third face spaced at a third dimension from the mounting aperture, the third dimension less than both the first and second dimensions.

13. The actuation mechanism of claim 11, further comprising:

a lock link coupled to the drive rod proximate the first side plate;

an over-center toggle rotatably connected to the lock link; and a drive link co-coupled with the over-center toggle to the lock link and rotatably connected to the pantograph linkage set.

14. The actuation mechanism of claim 13, further comprising:

a biasing element connected to both the over-center toggle and a bracket extending from the first side plate;

a centerline of the drive rod; and a centerline of the biasing element;

wherein in the stowed position, the centerline of the biasing element is positioned above the centerline of the drive rod.

15. The actuation mechanism of claim 14, further comprising a trip lever rotatably mounted to the first side plate proximate to the lock link and in contact with the lock link in the retracted position to prevent rotation of the lock link and release of the pantograph linkage set.

16. A furniture member actuation mechanism, comprising:

a frame including first and second lateral members and first and second transverse members coupled to the first and second lateral members;

opposed first and second side plates;

a first forward oriented link member and a first rearward oriented link member both connecting the first side plate to the first lateral member;

second forward and rearward oriented link members both connecting the second side plate to the second lateral member;

a first cross brace connecting the first and second forward oriented link members;

a second cross brace connecting the first and second rearward oriented link members;

each of the first and second cross braces including a brace web and first and second flanges extending substantially transverse to the brace web, and an end wall integrally connected to the brace web and extending substantially transverse to the brace web:

a partial cavity created between the end wall and each of the first and second flanges, the partial cavity operable to receive a predetermined one of the link members;

first and second polymeric motion inserts, the first motion insert connected to the first side plate and the second motion insert connected to the second side plate, each motion insert having an elongated slot;

first and second pins, the first pin inserted through the elongated slot of the first motion insert and the second pin inserted through the elongated slot of the second motion insert; and first and second seat back support elements, the first element rotatably coupled to the first side plate and rotatably linked to the first pin and the second element rotatably coupled to the second side plate and rotatably linked to the second pin.

17. The actuation mechanism of claim 16, further comprising a single fastener inserted through both the end wall and the predetermined one of the link members, the single fastener operable to engage the end wall and the predetermined one of the link members.

18. The actuation mechanism of claim 16, wherein the first and second cross braces, together with the first and second lateral members and first and second transverse members define a substantially rectangular shaped assembly having right angle corners retained by the cross braces during shipping and use.

19. A furniture member actuation mechanism, comprising:

a plate connected by first and second links to a frame;

first and second polymeric motion inserts connected to the plate, each of the motion inserts having an elongated slot;

a seat back support element rotatably connected to the plate;

a first pin slidably received in the elongated slot of the first motion insert and rotatably linked to both the seat back support element and the first link;

a leg rest support arm connected by a pantograph linkage set to the plate;

a second pin connected by a cross link to the first pin and rotatably coupled to the second link, the second pin slidable within the elongated slot of the second motion insert when the pantograph linkage set operates between each of a retracted and an extended position a drive rod extending through the plate having a centerline; and a lock link coupled to the drive rod;

an over-center toggle rotatably connected to the lock link;

a drive link co-coupled with the over-center toggle to the lock link and rotatably connected to the pantograph linkage set; and a biasing element connected to both the over-center toggle and a bracket extending from the plate, the biasing element having a centerline;

wherein in the retracted position, the centerline of the biasing element is positioned above the centerline of the drive rod.

20. The actuation mechanism of claim 19, further comprising a trip lever rotatably mounted to the plate proximate to the lock link and in contact with the lock link in the retracted position to prevent rotation of the lock link and release of the pantograph linkage set.

21. A furniture member actuationn mechanism, comprising:

a plate connected by first and second links to a frame;

first and second polymeric motion inserts connected to the plate, each of the motion inserts having an elongated slot;

a seat back support element rotatably connected to the plate;

a first pin slidably received in the elongated slot of the first motion insert and rotatably linked to both the seat back support element and the first link;

a leg rest support arm connected by a pantograph linkage set to the plate;

a second pin connected by a cross link to the first pin and rotatably coupled to the second link, the second pin slidable within the elongated slot of the second motion insert when the pantograph linkage set operates between each of a retracted and an extended position; and first and second biasing elements each engaged with and operable to bias one of the first and second pins.

22. The actuation mechanism of claim 21, further comprising first and second retaining elements each operable to both retain one of the first and second biasing elements in engagement with the first and second pins and movable with respect to the first and second pins to adjust a biasing force created by the biasing elements.

23. A furniture member, comprising:

a seat back a leg rest;

an actuation mechanism connected to both the seat back and the leg rest, the actuation mechanism operable to permit independent movement of the seat back with respect to the leg rest the actuation mechanism including:

first and second side plates;

a rear motion insert having an elongated slot connected to each of the first and second side plates;

a front motion insert having an elongated slot connected to each of the first and second side plates;

a pin inserted through each ofthe elongated slots of each of the front and rear motion Inserts;

a drive rod rotatably connected between tie first and second side plates;

a lock link coupled to the drive rod proximate the first side plate;

an over-center toggle rotatably connected to the lock link; and a plurality of pantograph linkage sets connected between each of the first and second side plates and the leg rest;

wherein the drive rod is induced to rotate by release of the over-center toggle and rotation of the lock link separately controls a leg rest position.

24. The furniture member of claim 23, wherein each of the front and rear motion inserts comprise a polymeric material.

25. The furniture member of claim 24, wherein the polymeric material comprises a polyamide material selected to reduce friction between the pin and each of the inserts.

26. The furniture member of claim 23, further comprising a drive link co-coupled with the over-center toggle to the lock link and rotatably connected to a first one of the pantograph linkage sets.

27. The furniture member of claim 26, further comprising:

a biasing element connected to both the over-center toggle and a bracket extending from the first side plate;

a centerline of the drive rod; and a centerline of the biasing element;

wherein in a stowed position, the centerline of the biasing element is positioned above the centerline of the drive rod.

28. The furniture member of claim 27, further comprising a trip lever rotatably mounted to the first side plate proximate to the lock link and in contact with the lock link in the retracted position to prevent rotation of the lock link and release of the pantograph linkage set.

29. The furniture member of claim 28, further comprising a release latch operable to displace the trip lever and allow rotation of the lock link using a biasing force of the biasing element.

30. The furniture member of claim 23, further comprising an elongated plate slot corresponding to each of the elongated slots of the front and rear motion inserts, the pin inserted through each of the elongated slots being concomitantly inserted through the elongated plate slot.

31. The furniture member of claim 23, further comprising first and second seat back support elements both operable to support the seat back, the first element rotatably coupled to the first side plate and rotatably linked to a first one of the pins, and the second element rotatably coupled to the second side plate and rotatably linked to a second one of the pins; wherein a rearward force applied by an occupant of the furniture member to the seat back is operable to create a rearward rotation of the seat back with the first and second pins slidable within the elongated slots, and a weight of the occupant when the rearward force is removed is operable to return the seat back to a pre-rotation position.

32. A furniture member actuation mechanism, comprising:

a plate connected by first and second links to a frame;

a seat back support element rotatably connected to the plate;

a leg rest support arm connected by a pantograph linkage set to the plate;

a drive rod rotatably disposed through the plate and rotatably linked to the leg rest support arm;

a lock link connected to the drive rod;

a trip lever rotatably connected to the plate and engageable with the lock link to prevent rotation of the lock link and the drive rod; and a biasing element connected between the plate and a distal end of the lock link and operable to bias the leg rest support arm in a stowed position.

33. The actuation mechanism of claim 32, further comprising first and second polymeric motion inserts connected to the plate, each of the motion inserts having an elongated slot.

34. The actuation mechanism of claim 33, further comprising a first pin slidably received in the elongated slot of the first motion insert and rotatably linked to both the seat back support element and the first link.

35. The actuation mechanism of claim 34, further comprising a second pin connected by a cross link to the first pin and rotatably coupled to the second link, the second pin slidable within the elongated slot of the second motion insert when the pantograph linkage set operates between each of a retracted and an extended position.

36. The actuation mechanism of claim 35, further comprising first and second biasing elements each engaged with and operable to bias one of the first and second pins.

37. The actuation mechanism of claim 32, wherein the trip lever further comprises a Y-shape having an engagement member rotatably coupled to the plate.

38. The actuation mechanism of claim 37, wherein the trip lever further comprises first and second rods spaced from the engagement member.

39. The actuation mechanism of claim 37, wherein the engagement member further comprises a neck portion and first and second side spherical portions extending from the neck portion, the engagement member providing a compound engagement between the trip lever and the plate.

40. The actuation mechanism of claim 37, wherein the biasing element defines a center of action spaced from an axis of rotation of the drive rod when the trip lever is engaged with the lock link.

41. A furniture member actuation mechanism, comprising:

opposed first and second side plates;

a drive rod rotatably disposed through both the first and second side plates;

first and second leg rest support arms each connected by a pantograph linkage set to the drive rod; and a cam connected to the second side plate, the cam including:

a plurality of faces each operable to engage a predetermined link of one of the pantograph linkage sets; and a plurality of detente apertures individually engaged by an extending element of the second side plate to temporarily fix one of the plurality of faces in contact with the predetermined link.

42. The actuation mechanism of claim 41, wherein the plurality of faces comprise:

a first face spaced at a first dimension from a mounting aperture of the cam;

a second face spaced at a second dimension from the mounting aperture, the second dimension less than the first dimension; and a third face spaced at a third dimension from the mounting aperture, the third dimension less than both the first and second dimensions.

43. The actuation mechanism of claim 42, wherein the cam further comprises a pin aperture operable to rotatably mount the cam, wherein a line of action of a force operable to extend or retract the first and second leg rest support arms extends through a central axis of the pin aperture to prevent rotation of the cam.

44. The actuation mechanism of claim 41, further comprising a biasing element engageable with the cam operable to bias the cam toward the extending element to releasably engage the extending element into one of the plurality of detente apertures.

45. The actuation mechanism of claim 41, further comprising an extension element extending outwardly from the cam, the extension element graspable for manually rotating the cam.

46. The actuation mechanism of claim 41, further comprising first and second seat back support elements, the first element rotatably coupled to the first side plate and the second element rotatably coupled to the second side plate.

47. A furniture member actuation mechanism, comprising:

opposed first and second side plates;

first and second polymeric motion inserts each connected to one of the first and second side plates, each motion insert having an elongated slot;

a first pin inserted through the elongated slot of the first motion insert;

a second pin inserted through the elongated slot of the second motion insert;

a drive rod rotatably disposed through both the first and second side plates;

first and second leg rest support arms each connected by a pantograph linkage set to the drive rod;

a cam rotatably connected to the second side plate, the cam including a plurality of detente apertures defining a plurality of cam detente positions; an4 a stop drive link rotatably connected to each of the first and second side plates and the drive rod and a force from an occupant's weight is converted by motion of the stop drive link into a rotational torque on the drive rod, the rotational torque operable to extend the first and second leg rest support arms, and an extension position of the leg rest support minis is predetermined by the cam positioned in individual ones of the detente positions.

48. The actuation mechanism of claim 47, further comprising a lock link connected to the drive rod operable to prevent rotation of the drive rod when engaged by a trip lever.

49. The actuation mechanism of claim 48, further comprising a flanged link rotatably connected to at least one of the first and second side plates, the flanged link operable to engage the stop drive link to prevent positioning of the cam in other than one of the detente positions.

50. A furniture member actuation mechanism, comprising:

a frame;

opposed first and second side plates rotatably linked to the frame;

a drive rod rotatably disposed through both the first and second side plates;

first and second seat back support elements, the first element rotatably coupled to the first side plate and the second element rotatably coupled to the second side plate;

a stop drive element coupled to the drive rod;

a flanged link rotatably connected to at least one of the first and second side plates;

wherein a rearward force applied by an occupant to both the first and second seat back support elements is operable to create a pre-recline position of the seat back support elements, the pre-recline position limited by contact between the stop drive element and the flanged link, and a weight of the occupant when the rearward force is removed is operable to return the seat back support elements to a pre-rotation position.

51. The actuation mechanism of claim 50, further comprising first and second leg rest support arms each connected by a pantograph linkage set to the drive rod, the first and second leg rest support arms being retained in a stowed position in the pre-recline position, and movable together with the first and second seat back support elements in a fully extended position of the mechanism.

52. The actuation mechanism of claim 50, wherein the stop drive element comprises a stop boss extending generally outwardly away from the stop drive element, the stop boss operable to contact the flanged link to limit the pre-recline position.

53. A furniture member actuation mechanism, comprising:

a frame;

opposed first and second side plates rotatably linked to the frame;

a drive rod rotatably disposed through both the first and second side plates;

first and second leg rest support arms each connected by a pantograph linkage set to the drive rod, the first and second leg rest support arms movable between a stowed position and a fully extended position by rotation of the drive rod;

a lock link connected to the drive rod;

a stop drive link coupled to the first side plate and rotatable with respect to the lock link;

a cam rotatably connected to the second side plate, the cam including a plurality of detente apertures defining a plurality of cam detente positions operable to adjust the first and second leg rest support arms in the fully extended position.

54. The actuation mechanism of claim 53, wherein the lock link is rotatable through substantially 90 degrees of rotation.

55. The actuation mechanism of claim 53, wherein the stop drive link is rotatable through substantially 120 degrees of rotation.

56. The actuation mechanism of claim 53, wherein the lock link comprises a journal bearing operable to support the stop drive link.

* * * * *

UNITED STATES PATENT AND TRADEMARK OFFICE

CERTIFICATE OF CORRECTION

PATENT NO. : 7,585,018 B2
APPLICATION NO. : 11/328772
DATED : September 8, 2009
INVENTOR(S) : Larry P. LaPointe It is certified that error appears in the above-identified patent and that said Letters Patent is hereby corrected as shown below:

Column 5, Line 57, after “forward”, insert -- ” --;

Column 7, Line 4, “prevents” should be -- prevent --;

Column 9, Line 6, “75' .At” should be -- 75'. At --;

Column 10, Line 15, “a” should be -- α --;

Column 11, Line 14, “P” should be -- β --;

Column 12, Line 20, “34, 35 .” should be -- 34, 35. --;

Column 13, Line 66, Claim 1, delete the second occurrence of “upright”;

Column 15, Line 13, Claim 10, Line 17, Claim 10, after “claim”, delete “a”;

Column 16, Line 38, Claim 16, Line 17, Claim 17, after “web”, the “:” should be -- ; --;

Column 17, Line 15, Claim 19, Line 14, Claim 23, after “position”, insert -- ; --;

Column 17, Line 61, Claim 23, Line 2, Claim 32, after “back”, insert -- ; --;

Column 18, Line 6, Claim 23, Line 12, Claim 32, “ofthe” should be -- of the --;

Column 18, Line 7, Claim 23, Line 13, Claim 32, “Inserts” should be -- inserts --;

Column 18, Line 8, Claim 2, Line 14, Claim 32, “tie” should be -- the --;

Column 20, Line 35, Claim 47, Line 17, Claim 56, delete “an4”;

Column 20, Line 37, Claim 47, Line 19, Claim 56, “rod and” should be -- rod; and --;

UNITED STATES PATENT AND TRADEMARK OFFICE

CERTIFICATE OF CORRECTION

PATENT NO. : 7,585,018 B2
APPLICATION NO. : 11/328772
DATED : September 8, 2009
INVENTOR(S) : Larry P. LaPointe It is certified that error appears in the above-identified patent and that said Letters Patent is hereby corrected as shown below:

Column 20, Line 42, Claim 47, Line 1, Claim 56, "minis", should be -- arms --.

Signed and Sealed this

Fifteenth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,585,018 B2
APPLICATION NO. : 11/328772
DATED : September 8, 2009
INVENTOR(S) : LaPointe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 600 days.

Signed and Sealed this

Fourteenth Day of September, 2010

David J. Kappos

David J. Kappos
*Director of the United States Patent and Trademark Office*